United States Patent [19]

Berzins

[11] 4,395,179

[45] Jul. 26, 1983

[54] APPARATUS AND METHOD FOR CHARGING MATERIAL INTO A RECEPTACLE

[75] Inventor: Andrejs Berzins, Parma, Ohio

[73] Assignee: Davy Inc., Cleveland, Ohio

[21] Appl. No.: 225,442

[22] Filed: Jan. 15, 1981

Related U.S. Application Data

[63] Continuation of Ser. No. 25,877, Apr. 2, 1979, abandoned, which is a continuation of Ser. No. 822,811, Aug. 8, 1977, abandoned, which is a continuation-in-part of Ser. No. 665,552, Mar. 10, 1976, Pat. No. 4,067,452.

[51] Int. Cl.[3] ..... F27B 9/38

[52] U.S. Cl. ..... 414/161; 266/184; 414/200; 414/201; 414/206; 414/786

[58] Field of Search ..... 414/161, 169, 170, 199–206; 193/2 R; 266/176, 184; 48/86 R

[56] References Cited

U.S. PATENT DOCUMENTS

| | | | |
|---|---|---|---|
| 2,625,305 | 1/1953 | Conkling | 193/2 R X |
| 3,780,890 | 12/1973 | Glover | 414/170 |
| 4,026,427 | 5/1977 | Greaves et al. | 414/161 |
| 4,074,816 | 2/1978 | Legille | 414/163 |

*Primary Examiner*—Robert G. Sheridan
*Attorney, Agent, or Firm*—Bernard, Rothwell & Brown

[57] ABSTRACT

Apparatus and method are disclosed for charging particulate material of varying sizes into a shaft furnace, such as an oil shale retort or blast furnace, in which a highly uniform distribution of particle sizes of charge material and a desired height and level of stockline are obtained. The apparatus comprises a non-rotatable distribution hopper having a dividing means beneath choked feed means to substantially equally divide the material into a plurality of port means. The apparatus also includes partially movable distributor means and spreader means having surfaces of different inclinations to thoroughly mix the variously sized particles. Also disclosed is apparatus for providing gas lock means to prevent loss of gas pressure from the furnace, sensing the stockline level in the furnace, weighing the material in a hopper, temporarily storing certain amounts of charge material, and controlling the operation of the apparatus. The method includes various processes by which the apparatus may be operated to produce a stockline of the desired height, configuration and uniformity.

22 Claims, 32 Drawing Figures

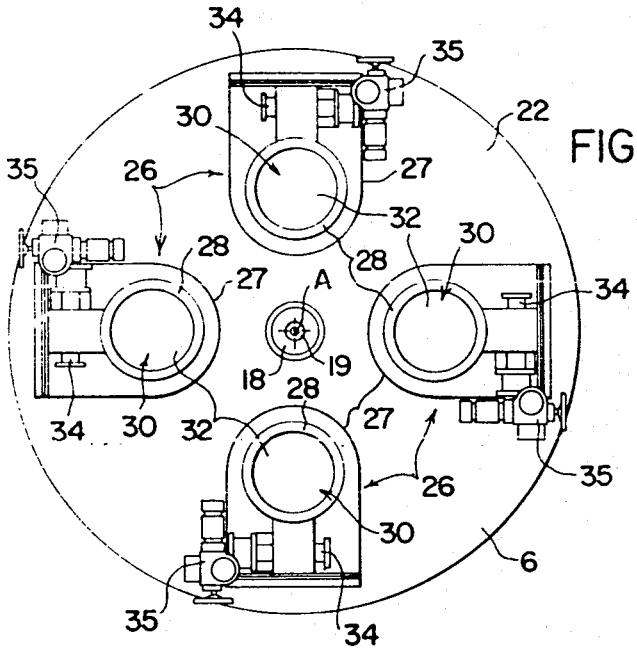
FIG. 2
FIG. 4
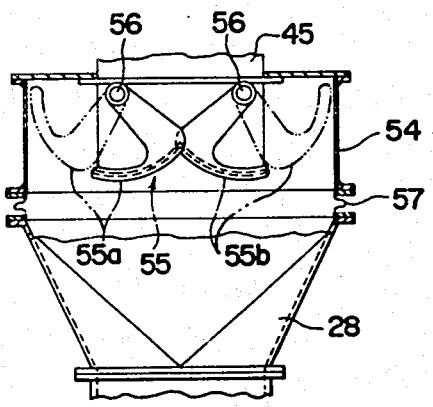
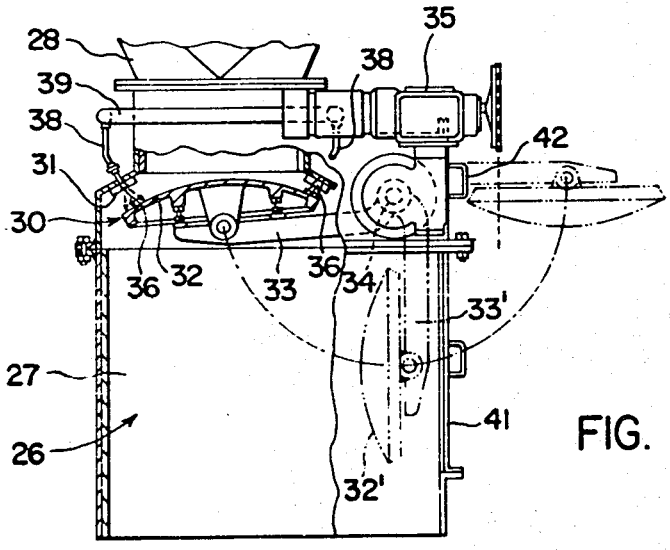
FIG. 3

| DESCRIPTION | COARSE | | | MEDIUM | | | FINE | | |
|---|---|---|---|---|---|---|---|---|---|
| | MEAN WT. % ($\bar{X}$) | STANDARD DEVIATION (S) | DEVIATION OF MEAN (%) | MEAN WT. % ($\bar{X}$) | STANDARD DEVIATION (S) | DEVIATION OF MEAN (%) | MEAN WT. % ($\bar{X}$) | STANDARD DEVIATION (S) | DEVIATION OF MEAN (%) |
| 5 DUMP AVG. | 53.166 | 7.616 | 0 | 32.671 | 4.574 | 0 | 14.162 | 4.621 | 0 |
| EAST HALF | 55.243 | 7.462 | 3.907 | 31.280 | 3.717 | 4.258 | 13.475 | 5.007 | 4.849 |
| NORTH EAST HALF | 55.200 | 7.907 | 3.826 | 31.421 | 4.413 | 3.825 | 13.377 | 4.607 | 5.544 |
| SOUTH EAST HALF | 54.227 | 7.699 | 1.996 | 31.832 | 3.972 | 2.568 | 13.940 | 5.079 | 1.570 |
| NORTH HALF | 53.925 | 7.854 | 1.428 | 32.361 | 4.932 | 0.949 | 13.714 | 4.431 | 3.167 |
| SOUTH HALF | 52.733 | 7.864 | 0.814 | 32.546 | 4.415 | 0.382 | 14.719 | 4.987 | 3.933 |
| NORTH WEST HALF | 52.431 | 7.958 | 1.383 | 33.075 | 5.221 | 1.238 | 14.493 | 4.367 | 2.336 |
| SOUTH WEST HALF | 51.458 | 7.386 | 3.213 | 33.486 | 4.708 | 2.495 | 15.056 | 4.728 | 6.310 |
| WEST HALF | 51.416 | 7.814 | 3.292 | 33.628 | 5.214 | 2.928 | 14.957 | 4.339 | 5.615 |
| INNER CIRCLE | 54.010 | 7.617 | 1.588 | 33.328 | 5.109 | 2.010 | 12.660 | 4.356 | 10.605 |
| OUTER CIRCLE | 52.648 | 6.971 | 1.281 | 31.580 | 4.021 | 3.341 | 15.773 | 4.591 | 11.372 |

APPARATUS AND METHOD FOR CHARGING MATERIAL INTO A RECEPTACLE

This is a continuation of application Ser. No. 025,877 filed Apr. 2, 1979, now abandoned, which is in turn a continuation of application Ser. No. 822,811, filed Aug. 8, 1977, now abandoned, which is a continuation-in-part of Ser. No. 665,552 filed Mar. 10, 1976, now U.S. Pat. No. 4,067,452.

DISCLOSURE OF THE INVENTION

1. Field of the Invention

This invention relates to apparatus and method for charging particulate material of varying sizes into a receptacle such as a blast furnace or upright oil shale retort or other shaft furnace, coal gasifier, or pyroprocessing preheater, kiln or cooler. More particularly it pertains to apparatus and method for charging particulate charge material into such a receptacle to distribute the material in the receptacle to provide a desired height and shape of the top surface or stockline of the body of material in the receptacle and high uniformity of distribution of sizes of particulate material in the body of charge material in the receptacle.

2. Background of the Invention

While the invention may be used for other purposes, it provides particular advantages when used in distributing particulate material into vertical oil shale retorts and into blast furnaces, and therefore the invention will be discussed below as so used.

In general, the known upright oil shale retort used for recovering oil from crushed particulate oil shale has an upright stack furnace portion. Particulate oil shale is introduced at the top to form a body of oil shale in the retort, through which the shale moves downwardly as the shale is heated to remove the oil containing components and other constituents, after which the spent oil shale is discharged from the bottom of the furnace portion.

Between the upper and lower portions of the body of shale in the retort, means is provided to heat the particulate oil shale to drive off the oil-containing constituents as vapors and gases. Recycled gases mixed with a predetermined amount of air are supplied in an amount predetermined to burn residual carbon in the oil shale, providing heat for driving off the oil-containing constituents and gases. Air is also supplied from the bottom or generally midway of the retort and travels upwardly through the body of shale. As the air progresses upwardly, it cools the hot spent shale and itself is preheated. Air thus preheated is used in combination with the fuel-air mixture at the heating means to burn residual carbon and provide necessary heat for the process. Heat for the process may also be supplied by recycling the product gases through a separate retort with the hot recycled gases supplying the heat required for the process. The oil-containing constituents and gases are removed by heat from the shale in the form of oil vapor mixed with gases and water vapor, which mixture moves upwardly through the body of oil shale and enters the space above the oil shale in the upper portion of the retort, from which it is removed. Since this mixture of gases and oil and water vapor is hot, it preheats the oil shale as it moves downwardly in the body of shale in the retort.

Heretofore, means has been provided for charging, by gravity feeding, the crushed particulate oil shale into the upper portion of the retort. Such charging means has been intended to distribute the crushed particulates across the cross section of the interior of the retort to form a desired stockline. The charging means heretofore used for distributing the crushed particulates in the upper part of the retort, however, have been deficient in various respects, particularly when the cross section of the retort is large.

When the oil shale is crushed prior to being charged into the retort, the crushing invariably produces particles of a wide variety of sizes. Even if the crushed oil shale is screened preparatory to being charged into the retort, it still consists of particles of widely varying sizes. If the crushed oil shale moves along an inclined surface as often occurs in known chargers, this tends to cause the smaller particles or fines to segregate from the larger particles because the smaller particles tend to move generally downwardly or vertically while the larger particles tend to move outwardly and more horizontally after they strike the inclined surface. Consequently, the crushed particulate oil shale charged into the retort tends to segregate, which can provide detrimental results during the retorting treatment of the shale, unless provided against.

The dynamic mechanical activity of the different particle sizes also has an effect on the distribution. The larger particles have a rolling action combined with an action of sliding down inclined surfaces while the small particles are mostly confined to a sliding action. Some of the larger particles continue to roll after reaching the stockline, whereas the smaller particles remain where they drop. As a result, in known chargers the larger particles are scattered over a wide area in the receptacle, while the smaller particles are generally concentrated.

Segregation of the smaller particles or fines from the larger particles in the retort is very disadvantageous because the fines tend to agglomerate to form clinkers which cause nonuniform operation of the retort, and in fact failure in operation at times. Nonuniform operation occurs because the clinkers, or other larger sizes of oil shale particles caused by nonuniform distribution, permit gas passing through the body of oil shale in the retort to channel through portions of the body containing the segregated larger particles, leaving other portions of the body of charge material insufficiently treated to remove satisfactorily the oil-containing constituents and fuel gas.

Similar channeling can occur if the stockline of the charge material in the retort varies substantially in height since gas will preferentially flow through the lowest portions of the stockline because it will flow through less material.

Similar problems occur in the feeding of particulate charge material into blast furnaces.

To achieve greater production and increased efficiencies and economies of blast furnace construction and operation, recent blast furnace designs have tended toward large furnaces of substantially higher internal top pressures of gas than have heretofore been common. In new furnaces being designed or built, top pressures range as high as 40 pounds per square inch gage (psig), hearth diameters range up to 50 feet or more, and diameters at the stockline vicinity range up to 30 feet or more, while iron productions range up to 10,000 tons per day.

These factors of high gas pressure, large furnace size, and large production have imposed severe problems in the design and operation of the charging apparatus for such furnaces to permit charging of the large quantities of charge materials in the desired even and uniform distribution over the large internal cross-sectional area of such furnace, to prevent during and between charging leakage of the gas at such high pressures, and to prevent fluidization of the charge material within the furnace due to irregularities in the stockline that can cause localized channeling through the mass of charge material in the furnace and improper furnace operation.

With the enlargement of blast furnaces, the establishment and maintenance of a highly uniform distribution of particles in the burden and a stockline free of substantial irregularities in height have become increasingly important in making possible successful and efficient operation. There must be highly uniform gas permeability since the adverse effects of channeling are magnified in a larger furnace. However, in larger blast furnaces, most known charging apparatus cannot satisfy use requirements, and therefore it has often been necessary to provide large blast furnaces with adjustable stockline armor to promote the formation of a stockline of desired configuration. Such armor is not only costly, but provides troublesome operating and maintenance problems.

Uniform distribution of particles of different sizes is important in blast furnaces in providing a burden permeability sufficiently uniform to prevent channeling. Such uniform permeability depends upon sufficiently uniform distribution of particles of different sizes, particularly fine particles. A highly uniform distribution of particles of different sizes in the burden results in the optimum gas-to-solids contact, producing better blast furnace operation, because the resulting uniform gas flow provides uniform reduction of iron oxides and improved thermal efficiency. Such uniform particle distribution also makes possible a flatter cohesive zone that better utilizes the blast and prevents raceway degradation due to the presence of molten material which was not processed in the cohesive zone.

Charging apparatus and methods heretofore used in shaft furnaces, such as oil shale retorts and blast furnaces usually have not provided sufficiently accurate control of stockline configuration and height or uniformity of particle distribution desirable for such purposes.

Widely used known charging apparatus having one or more vertically movable bells have usually been deficient because, among other things, they do not insure that a level stockline in the desired height could be provided and maintained, and because at least the bottom bell had inclined surfaces which usually caused flow patterns such that the fines tended to segregate in generally cylindrical columns in the body of material in the furnace, causing permeability variations and problems as described above.

Prior charging apparatus having rotatable components such as hopper or chutes in general have been deficient in that they do not insure that the particulate charge material is spread uniformly, do not provide a substantially uniform mixture of large and small particles of the charge material, and do not maintain a desired height and contour of the stockline. For example, if the charge material should be supplied by a belt conveyor and the finer particles of the charge material should be located on and discharged at one side of the belt into a rotating component, the rotating component would cause the fines to be largely distributed over only about half of the cross section of the furnace. Moreover, the prior types of charging apparatus having rotatable components with inclined surfaces such as chutes inside the furnace also tend to cause segregation in the body of the charge material because of the tendency of finer particles to segregate from the larger particles during gravity flow of the material over such inclined surfaces. Rotatable components also involve problems in sealing of such components whether either inside or outside of the receptacle. In addition, the complicated construction and maintenance of apparatus with rotatable components are usually undesirably costly.

Furthermore, problems have arisen with both types of such prior charging apparatus when it was attempted to feed particulate charge material continuously through such apparatus of a number of receptacles connected by belts or other conveyor means to a source of particulate material such as an oil shale crushing mill. This has arisen because such charging apparatus generally requires material to be delivered to it discontinuously, whereas the system for feeding charging apparatus of a sizeable number of receptacles from a single source does not lend itself to discontinuous feeding, and continuous feeding would introduce complications in the conveyor system.

SUMMARY OF THE INVENTION

It is an object of the invention to avoid the above and other problems and disadvantages of the prior art apparatus and methods.

It is a further object to provide apparatus and method for charging material into a receptacle, such as a blast furnace or an oil shale retort, that will operate efficiently in large or small receptacles, to charge desired quantities of particulate material to provide a highly uniform distribution of particle sizes of charge material in the body of charge material in the receptacle, to provide and maintain the desired height of the charge material in the receptacle, and to provide a desired level or other stockline configuration.

The present invention provides apparatus for charging particulate charge material into a receptacle, such as a blast furnace or an oil shale retort, comprising a choked feed means above the receptacle adapted to discharge charge material downwardly in a stream of compact cross section, a nonrotatable dividing means directly below the choked feed means adapted to divide the downwardly flowing stream of compact cross section into a plurality of streams, gas lock means at the upper portion of the receptacle, and means for causing the plurality of streams of charge material to pass through the gas lock means into the receptacle.

The invention further comprises apparatus of the above type comprising distributor means within the upper portion of the receptacle, the gas lock means being independent of the distributor means, and a nonrotatable external distribution hopper outside of the receptacle including the choked feed means in its upper portion and the dividing means in its lower portion, the distribution hopper means being adapted to receive charge material and to discharge the charge material into the receptacle through the gas lock means.

The invention further embodies apparatus of either of the two immediately preceding paragraphs comprising distributor means having an outer distributor member having a lower opening into which member charge material is deposited from the distribution hopper, and an inner distributor member having a maximum perimeter smaller than but approaching the cross section of the opening in the outer member, and means for causing relative movement between the distributor members in an upright path between a position in which the maximum perimeter of the inner distributor member is below the opening in the outer distributor member and a position in which its maximum perimeter is above the opening in the outer distributor member.

The invention further embodies apparatus of any of the three immediately preceding paragraphs and which comprises spreader means in the receptacle above the inner distributor member, with a bell hopper above the outer distributor member having a bottom opening adapted to be closed by a bell, the bell having a lower perimeter that is substantially greater than the perimeter defined by the opening in the hopper so that when the upper bell is lowered it discharges charge material laterally for a substantial distance into the lower distributor hopper.

The invention also embodies apparatus such as that of any of the four preceding paragraphs comprising a receiving hopper above the distribution hopper adapted to receive charge material substantially continuously from a source such as a belt conveyor, temporarily store it, and discharge charge material into the distribution hopper until a predetermined amount of charge material is discharged into the distribution hopper from whence it is discharged into the receptacle.

The invention further embodies a method for charging particulate charge material into a receptacle and for distributing the charge material evenly and uniformly in the receptacle, in which the method comprises introducing charge material into a nonrotatable distribution hopper in a stream of compact cross section, dividing the charge material into a plurality of streams, and discharging the charge material into the receptacle substantially without reduction of gas pressure in the receptacle upon sensing that the stockline has moved below a predetermined height.

BRIEF DESCRIPTION OF THE DRAWINGS

These and other advantages of the invention will become apparent from the following description of preferred embodiments of the apparatus and method in connection with the accompanying drawings:

FIG. 2 is a section along line 2—2 of FIG. 1 and to a larger scale;

FIG. 3 is a detail to a larger scale of one of the gas sealing valves;

FIG. 4 is a detail to the scale of FIG. 3 of the material holding gates;

Figure 1:
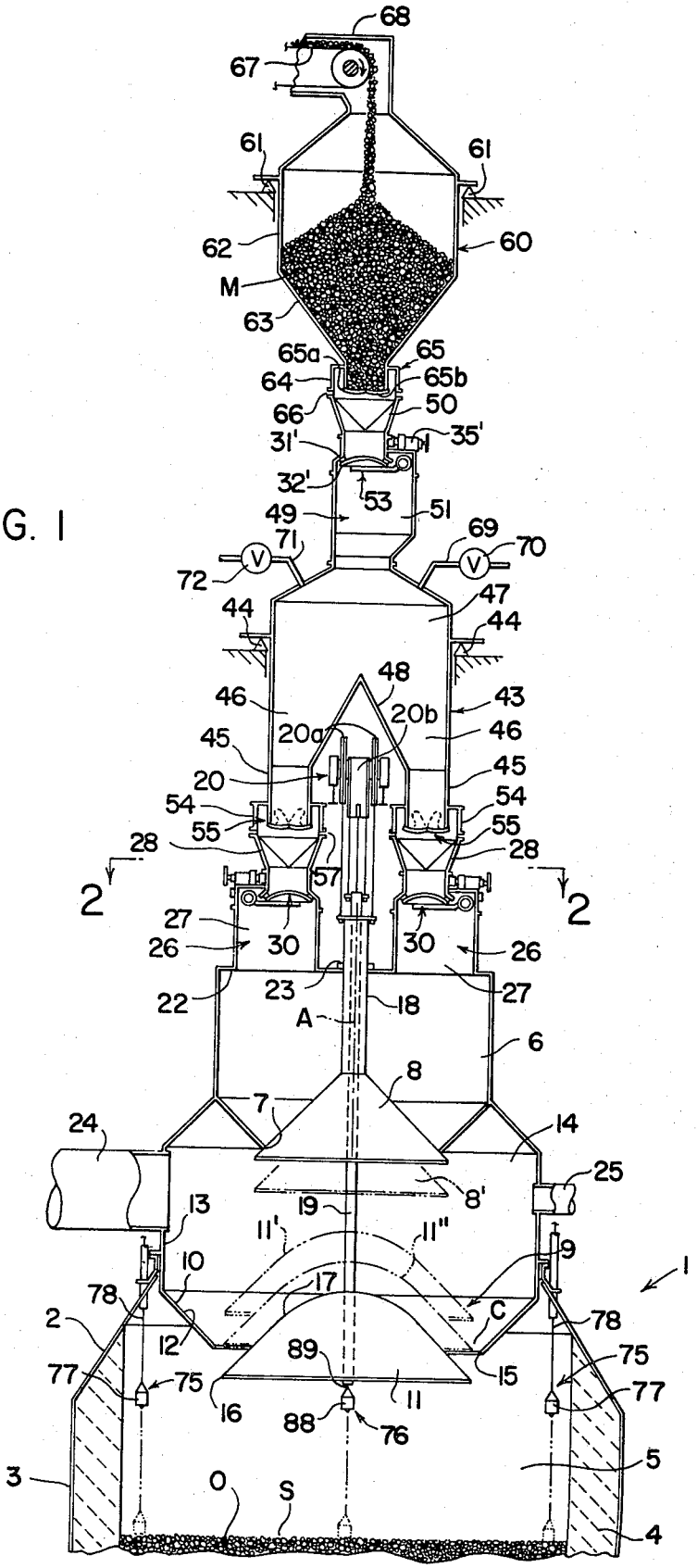
FIG. 1 is a vertical section through the upper part of an oil shale retort or shaft furnace including charging apparatus embodying the invention.
Figure 8:
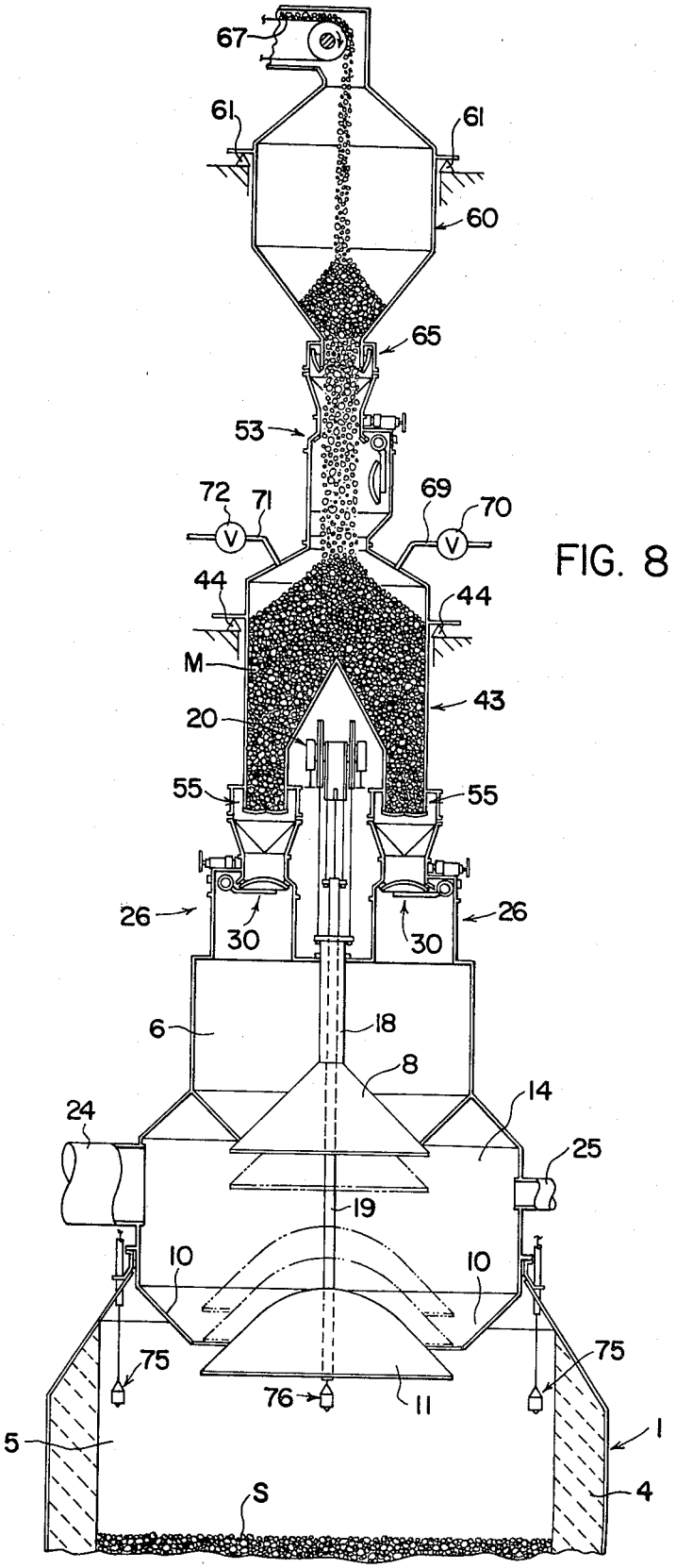
Figure 9:
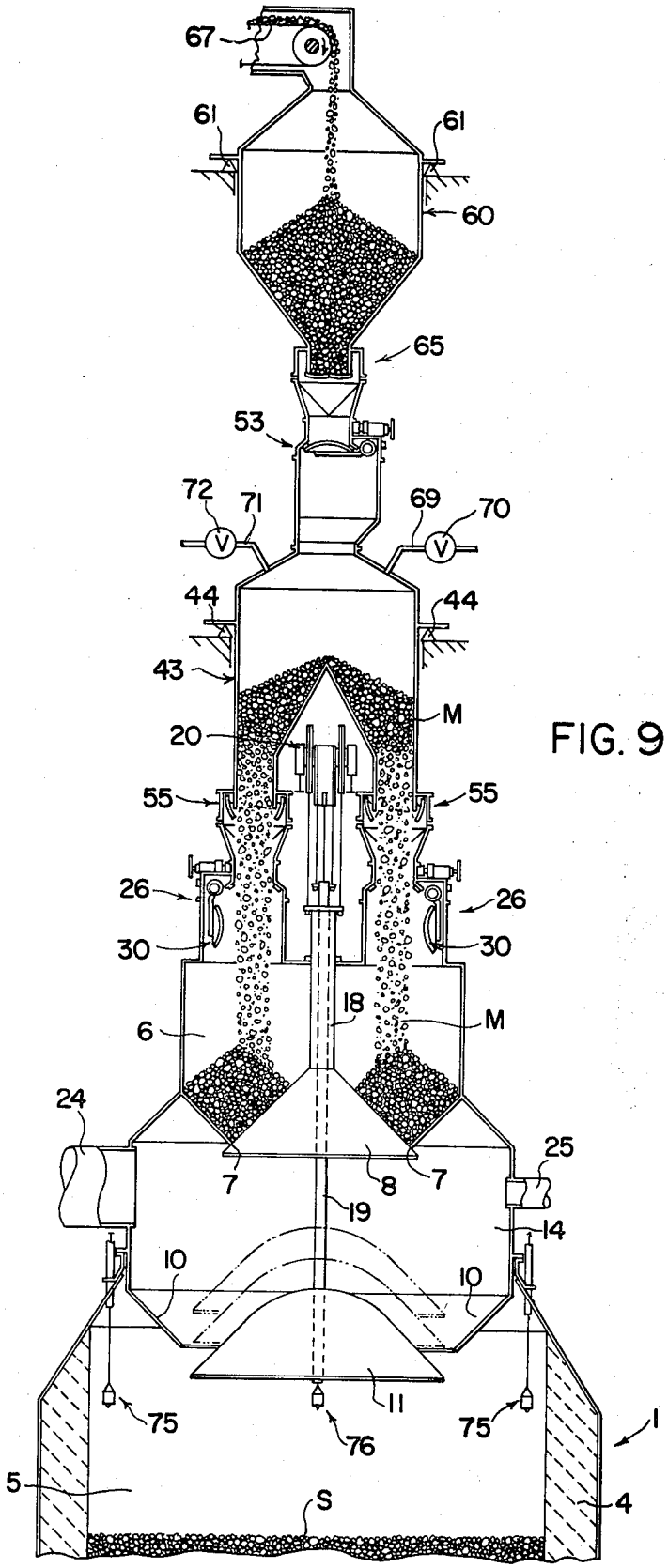
Figure 10:
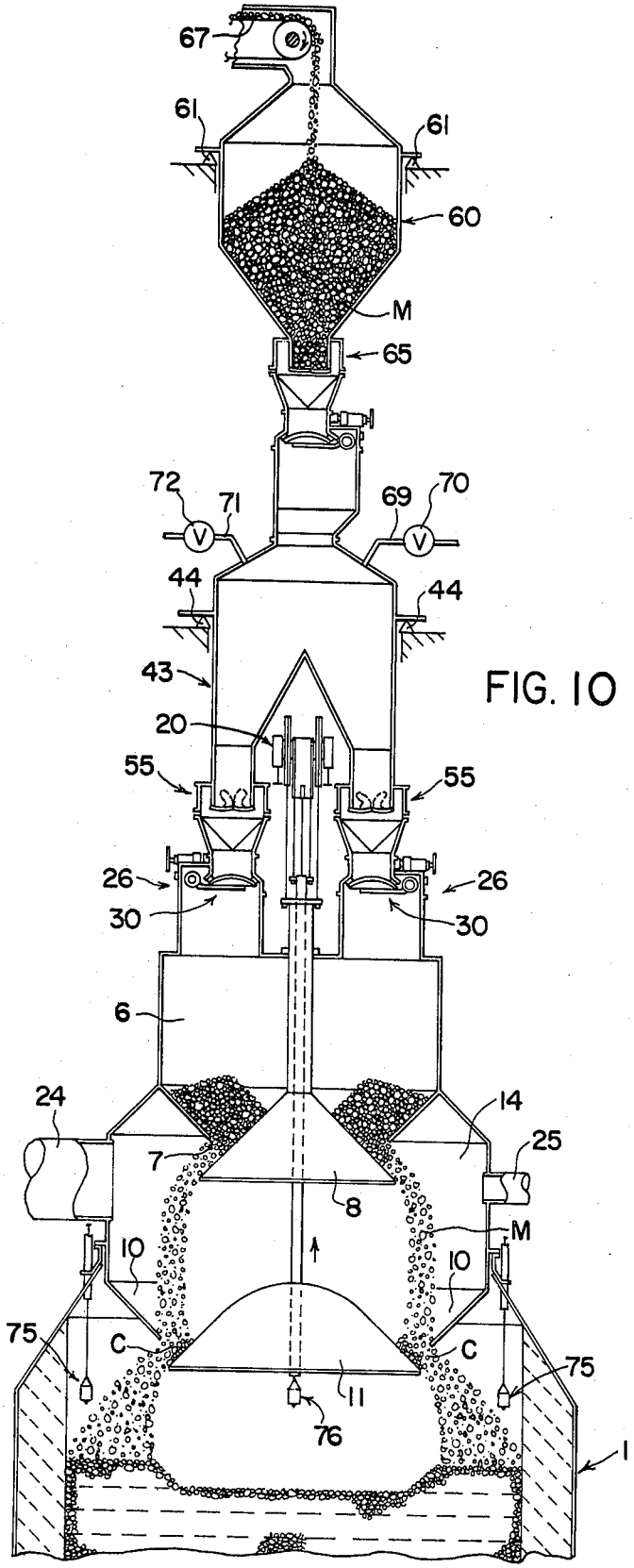
Figure 11:
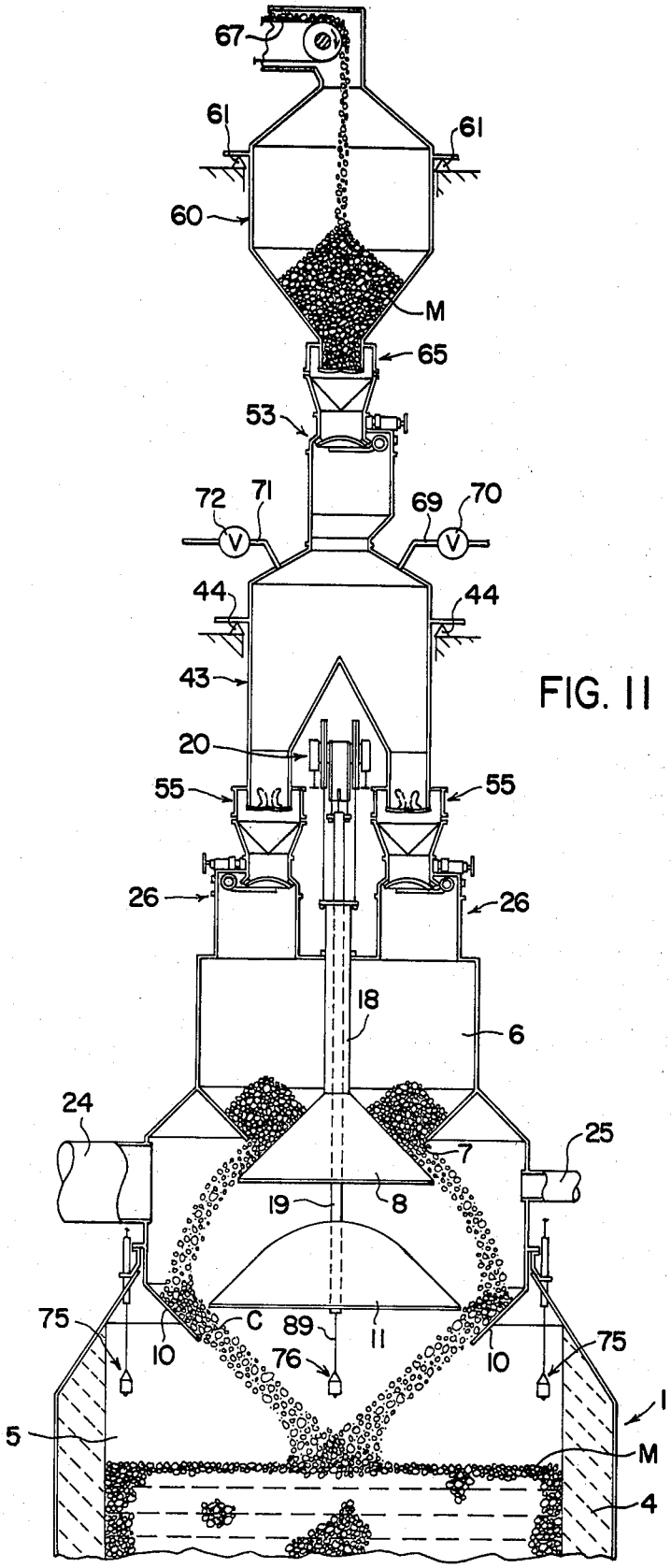
Figure 12:
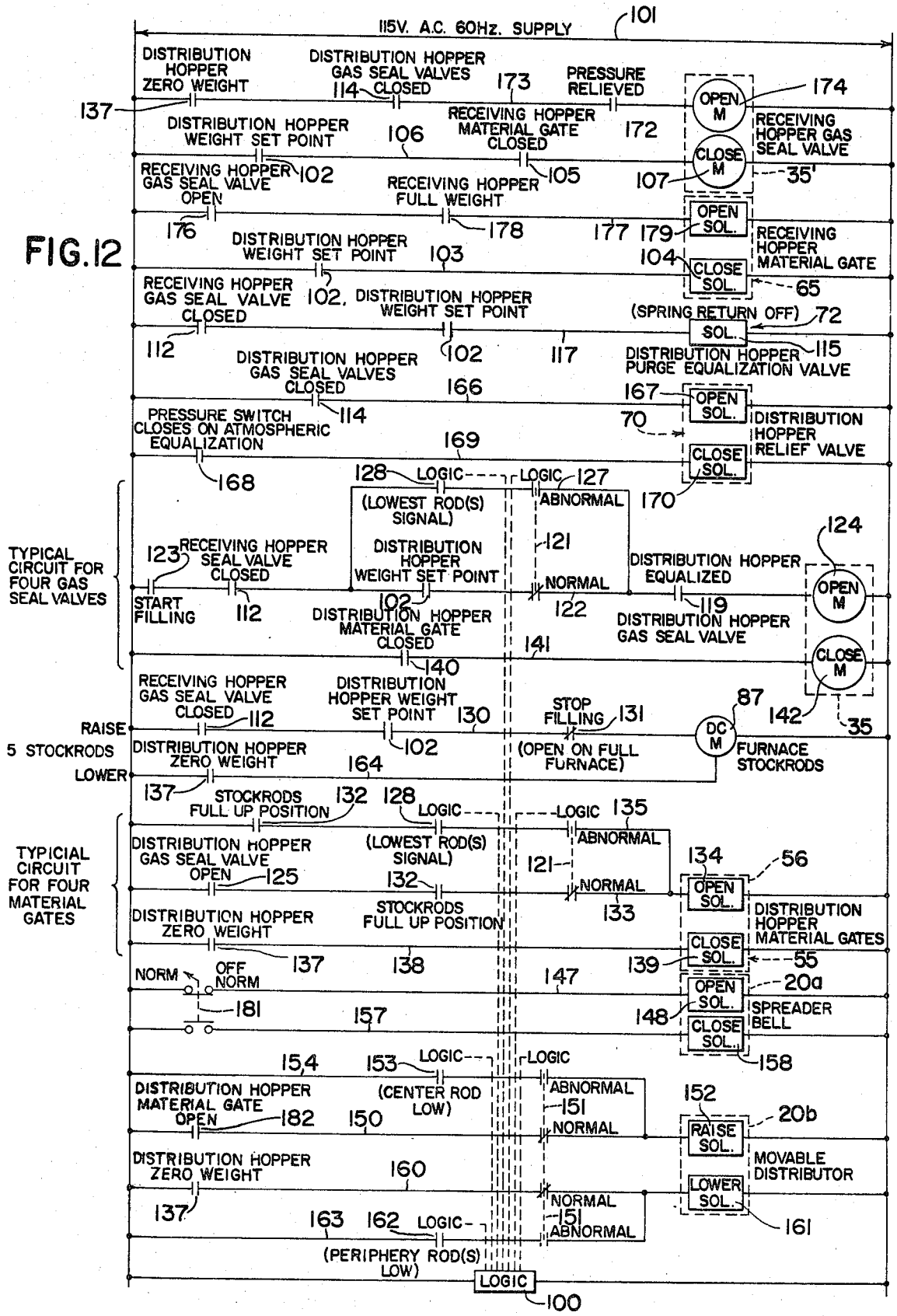

FIGS. *7a* and *7b* are schematic views of an electrical circuitry and logic system for controlling the apparatus of FIG. 1;

FIG. 8 is a view of the apparatus of FIG. 1 and to the same scale, illustrating a step in a preferred method of operation using the control system of FIGS. *7a* and *7b*;

FIG. 9 is a view of the same apparatus showing a following step in such method of operation;

FIG. 10 is a view of the same apparatus showing another following step in the method of operation;

FIG. 11 is a view of the same apparatus showing another following step in the method of operation;

FIG. 12 is a schematic view similar to that of FIGS. *7a* and *7b* showing a modified electrical circuitry and logic system for controlling the apparatus.

Figure 13:
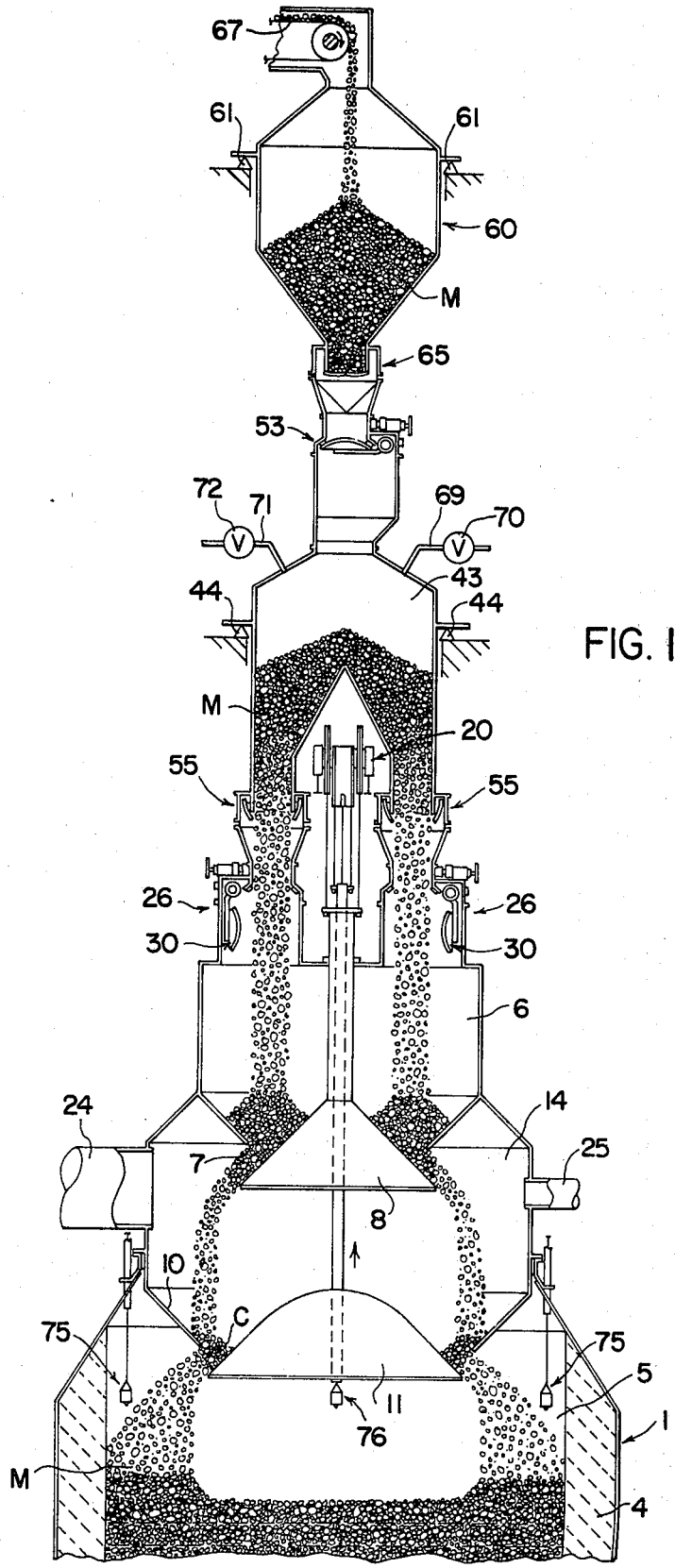
Figure 14:
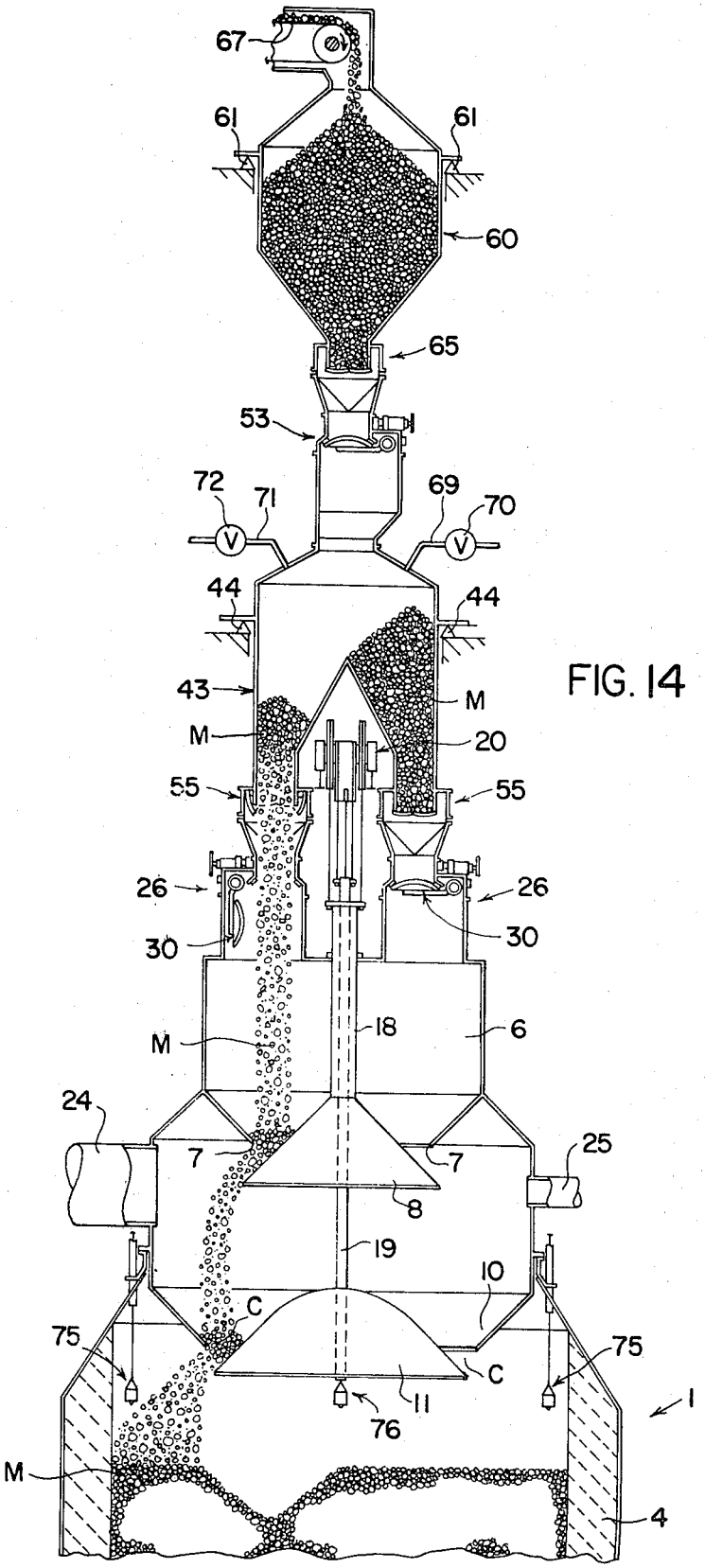
Figure 15:
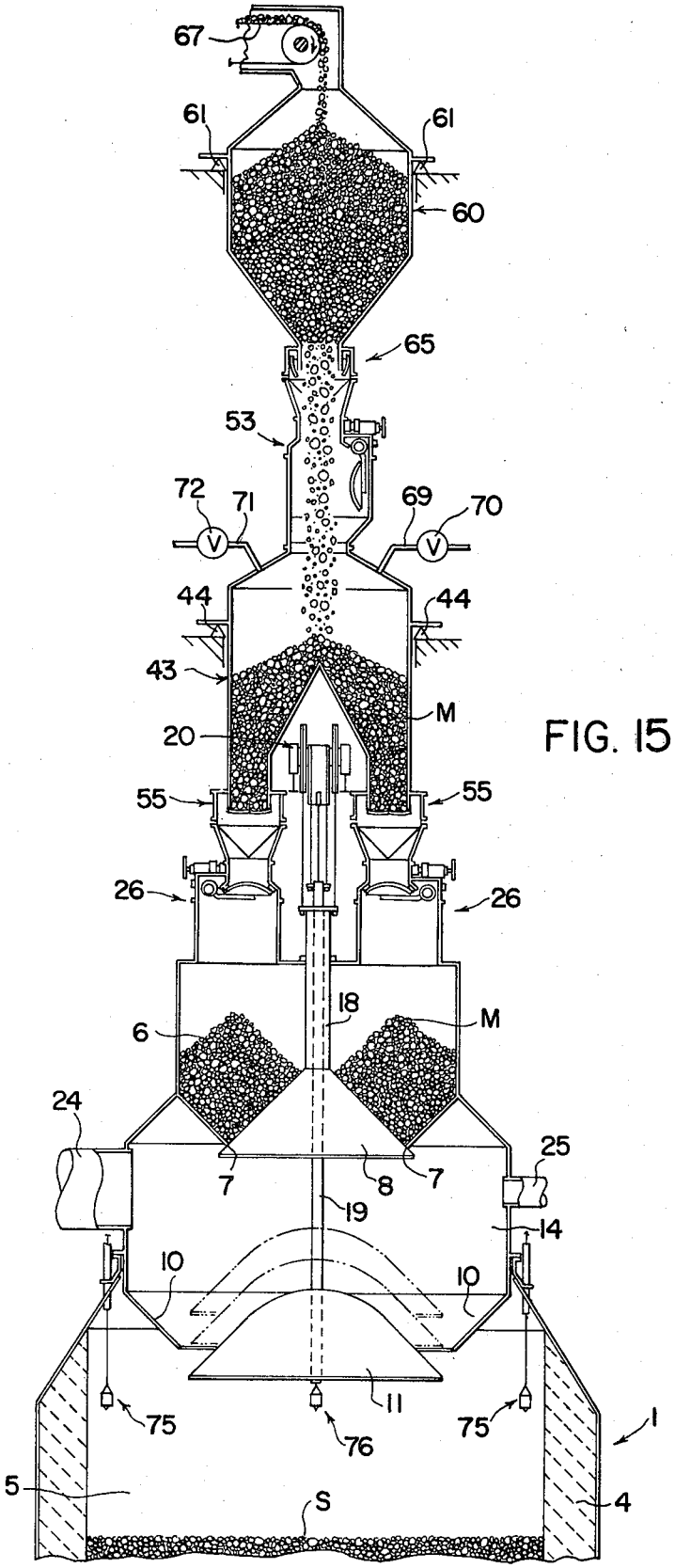
Figure 16:
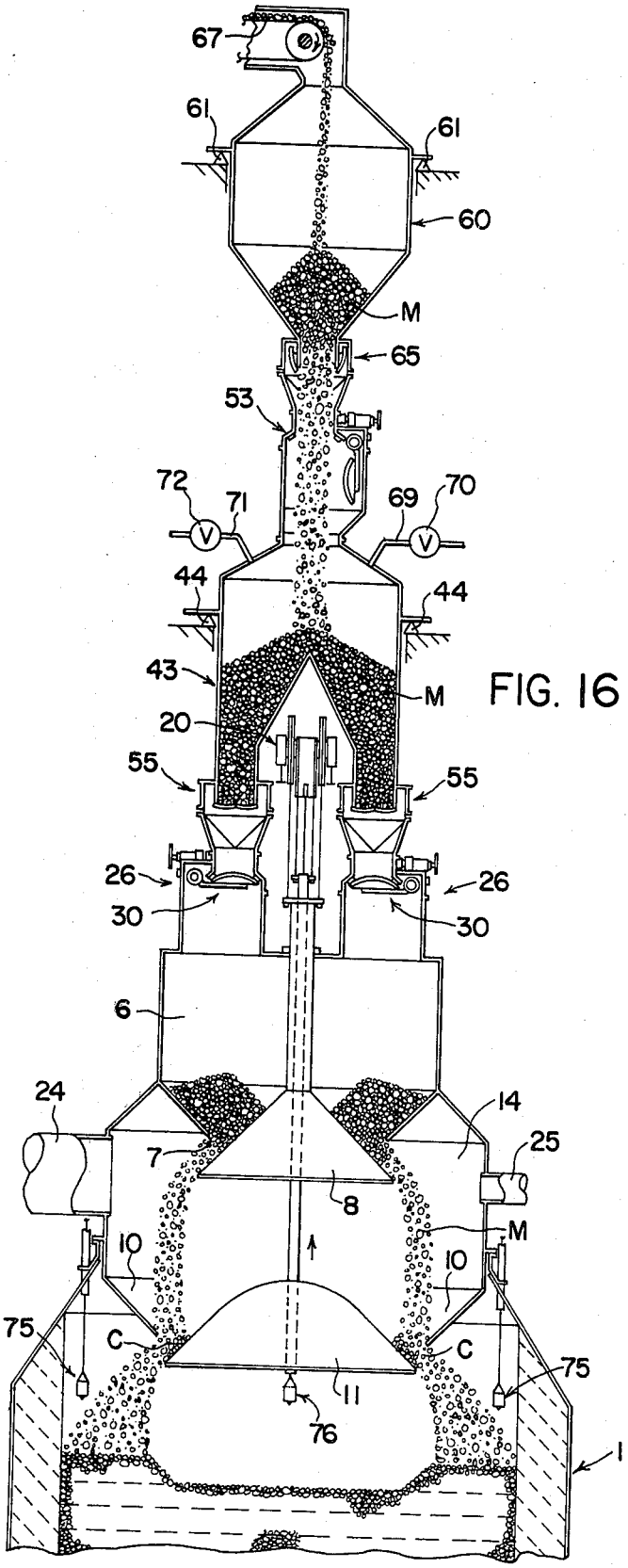
Figure 17:
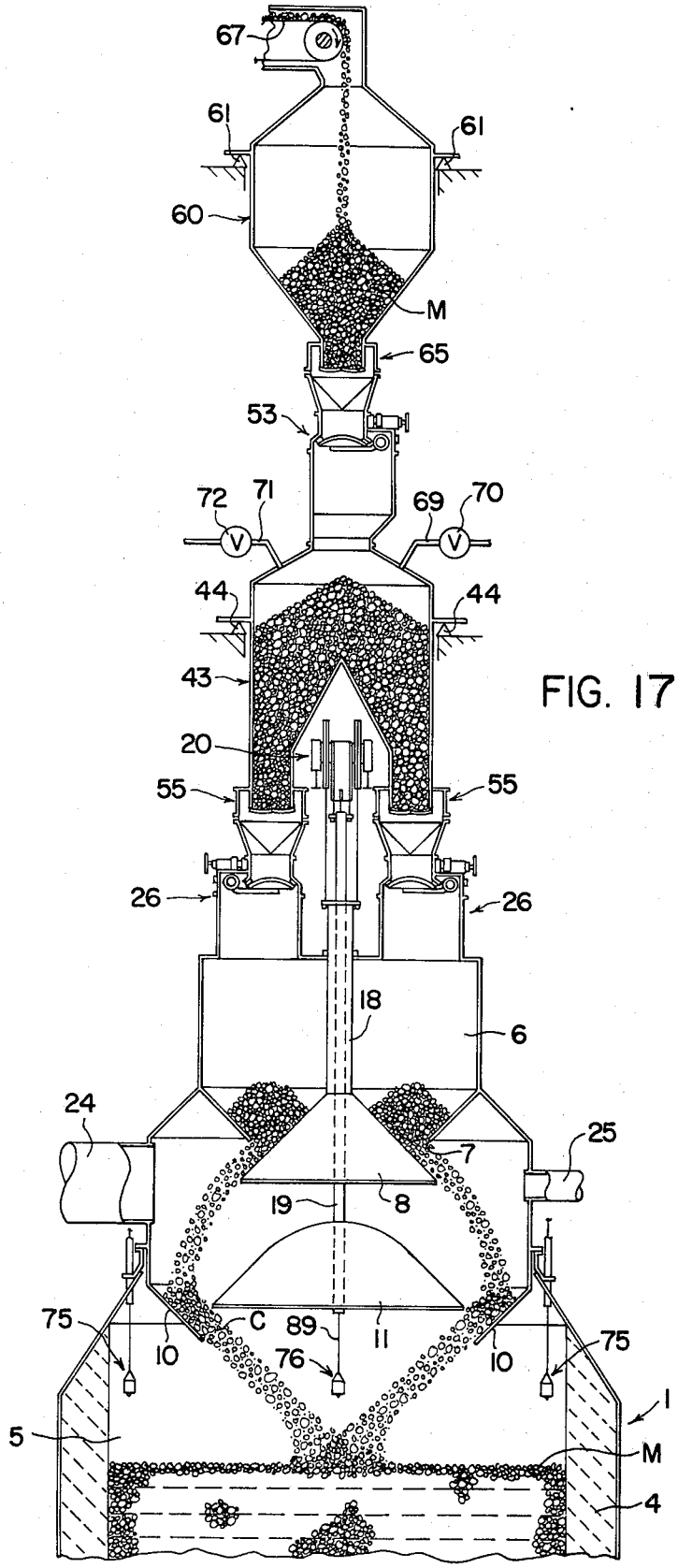
Figure 18:
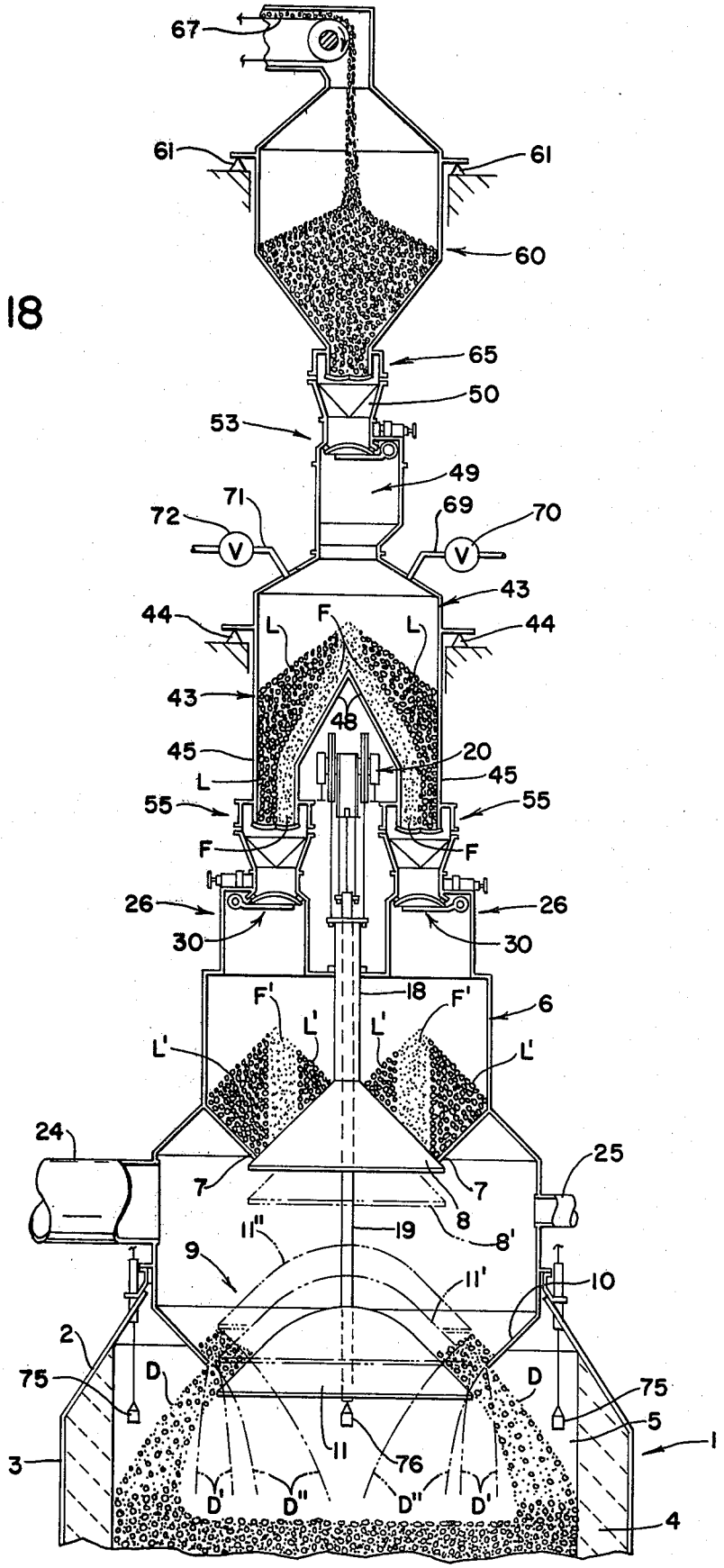
Figure 19:
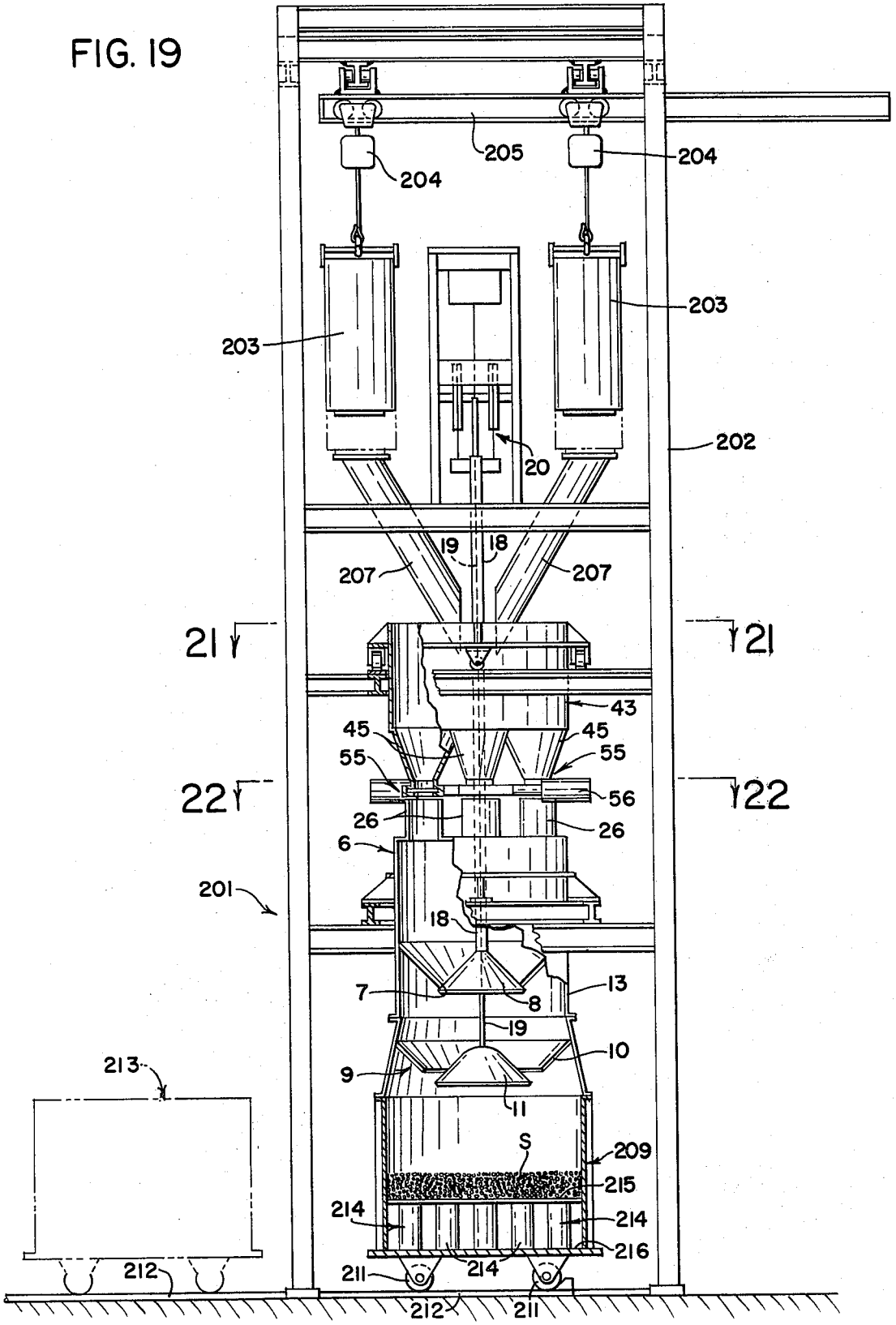
Figure 20:
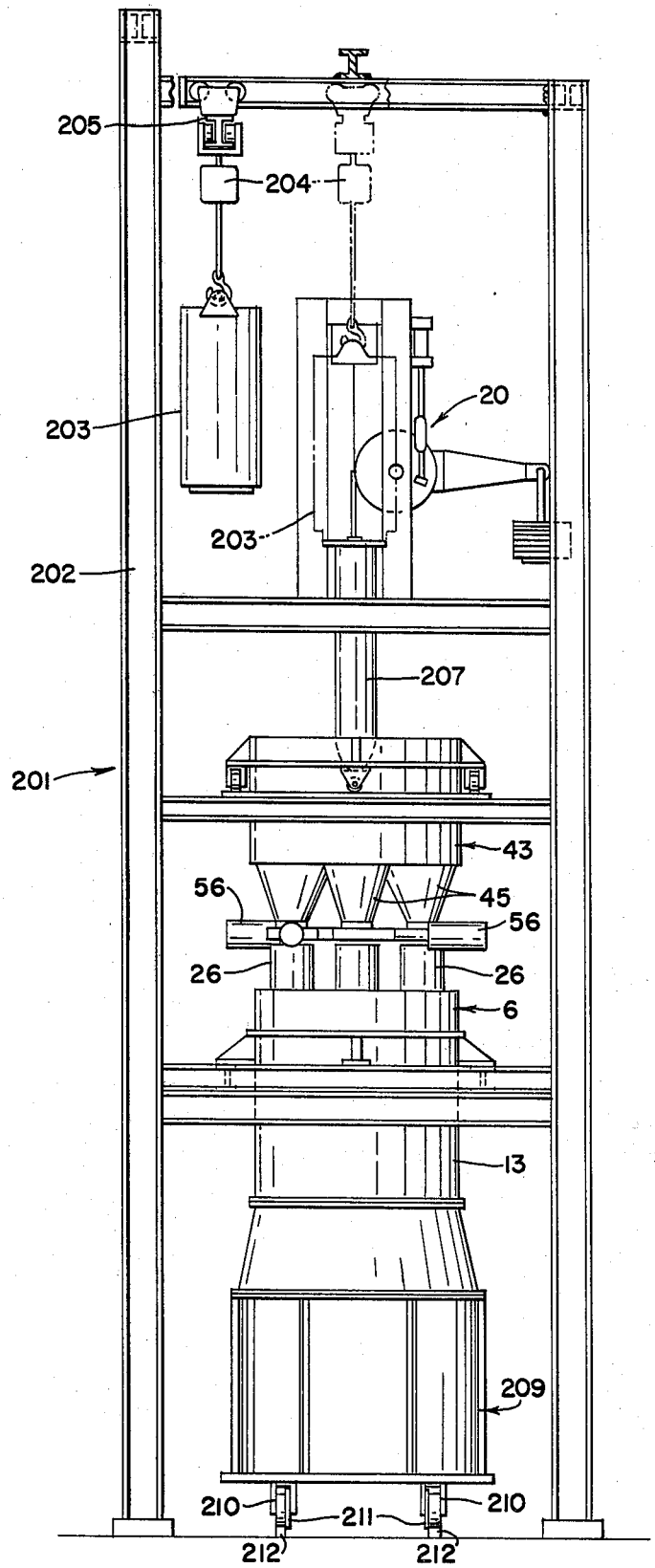
Figure 21:
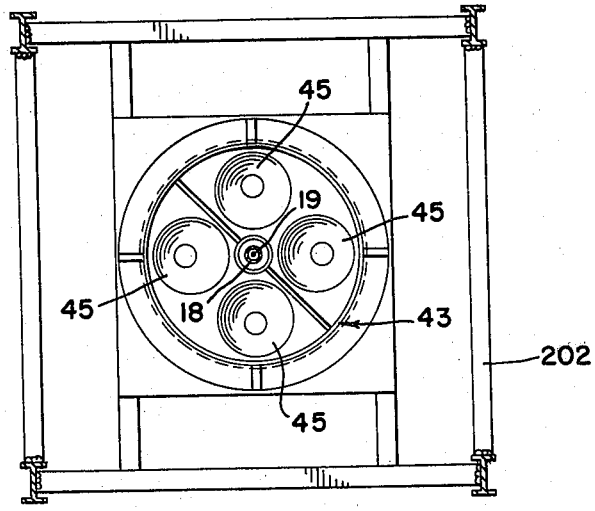
Figure 22:
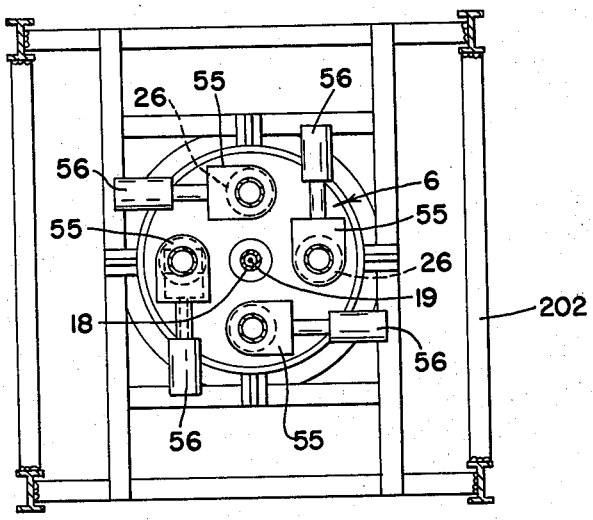
Figure 23:
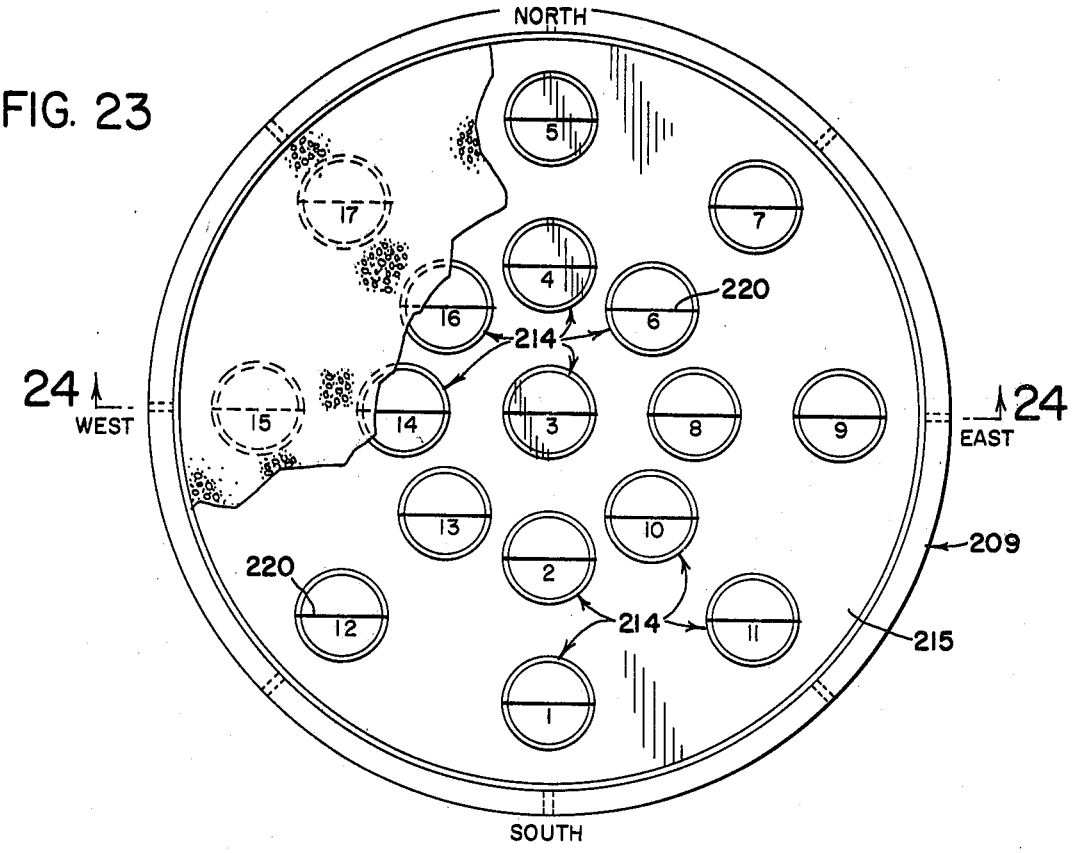
Figure 24:
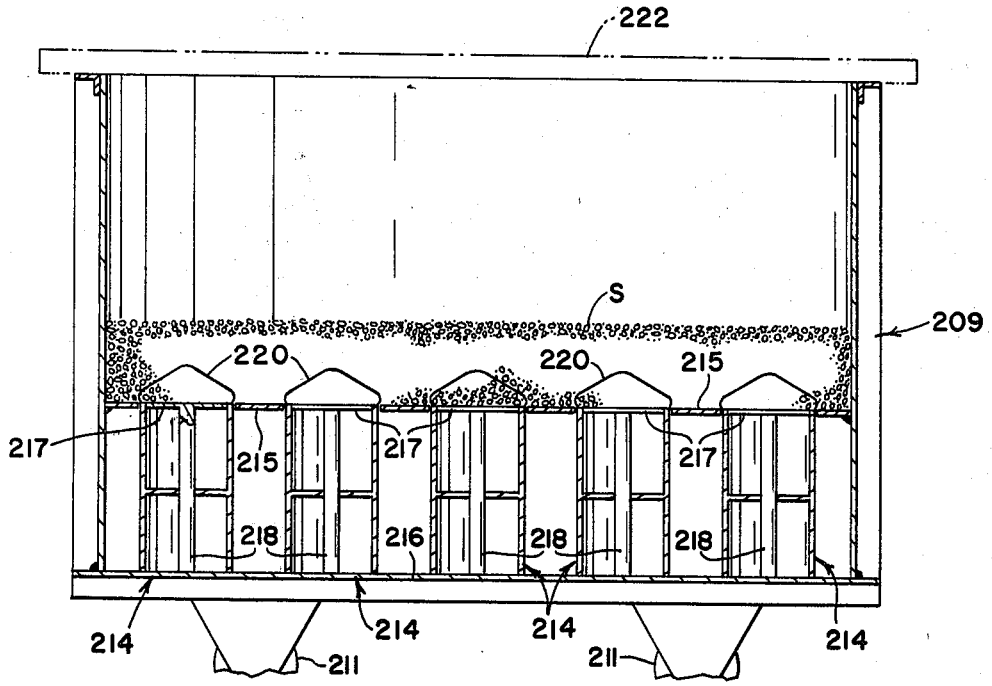
Figure 25:
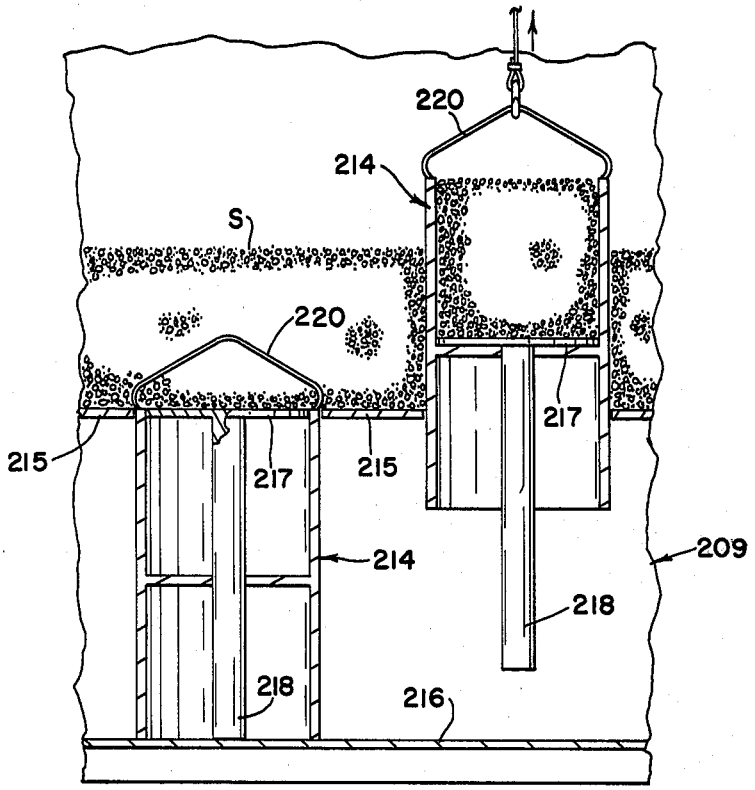
Figure 26:
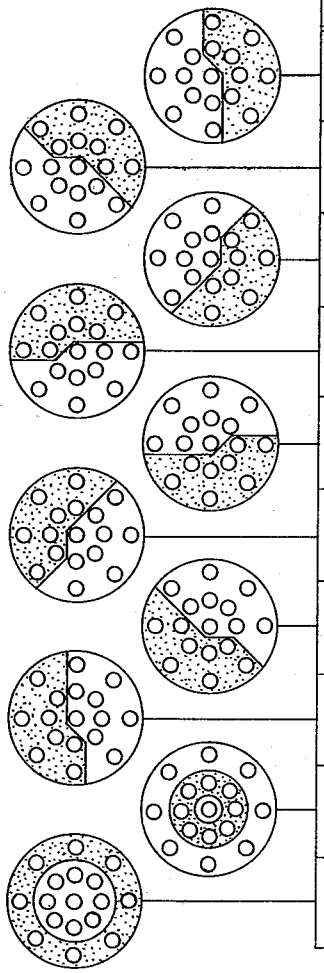
Figure 27:
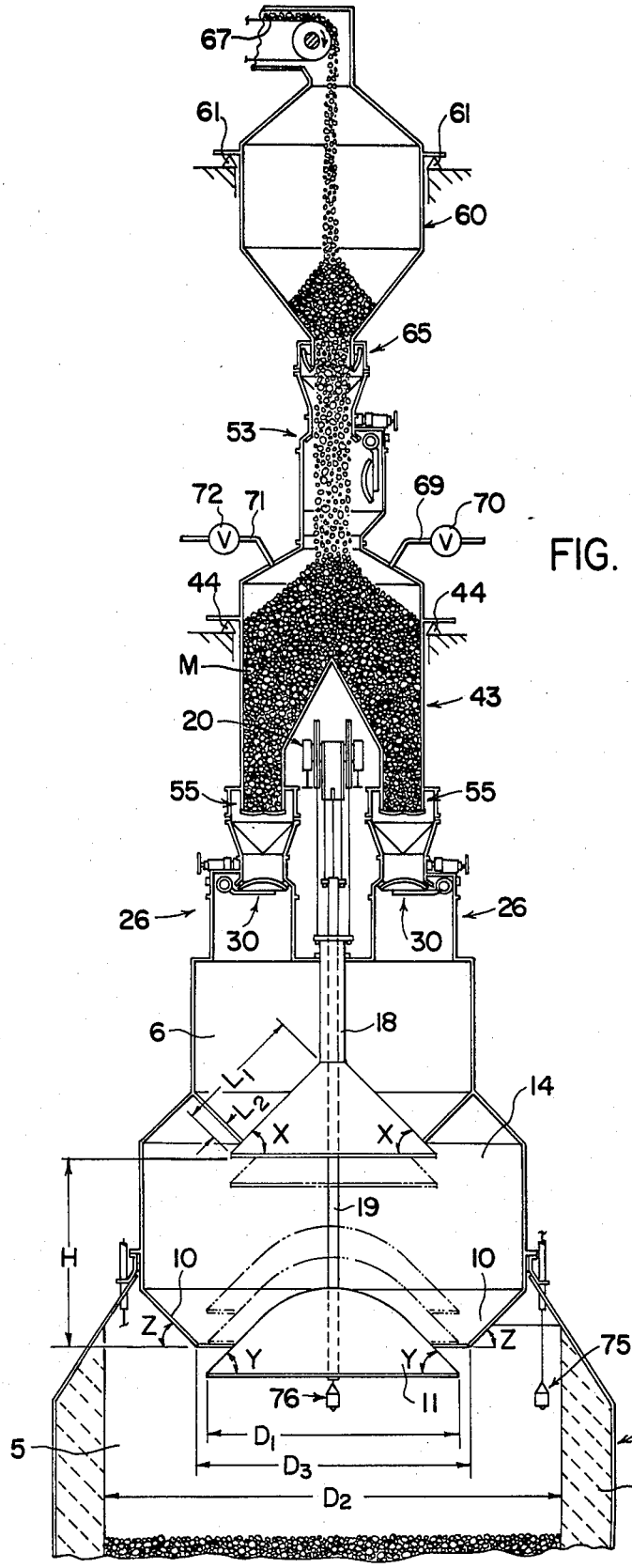
Figure 28:
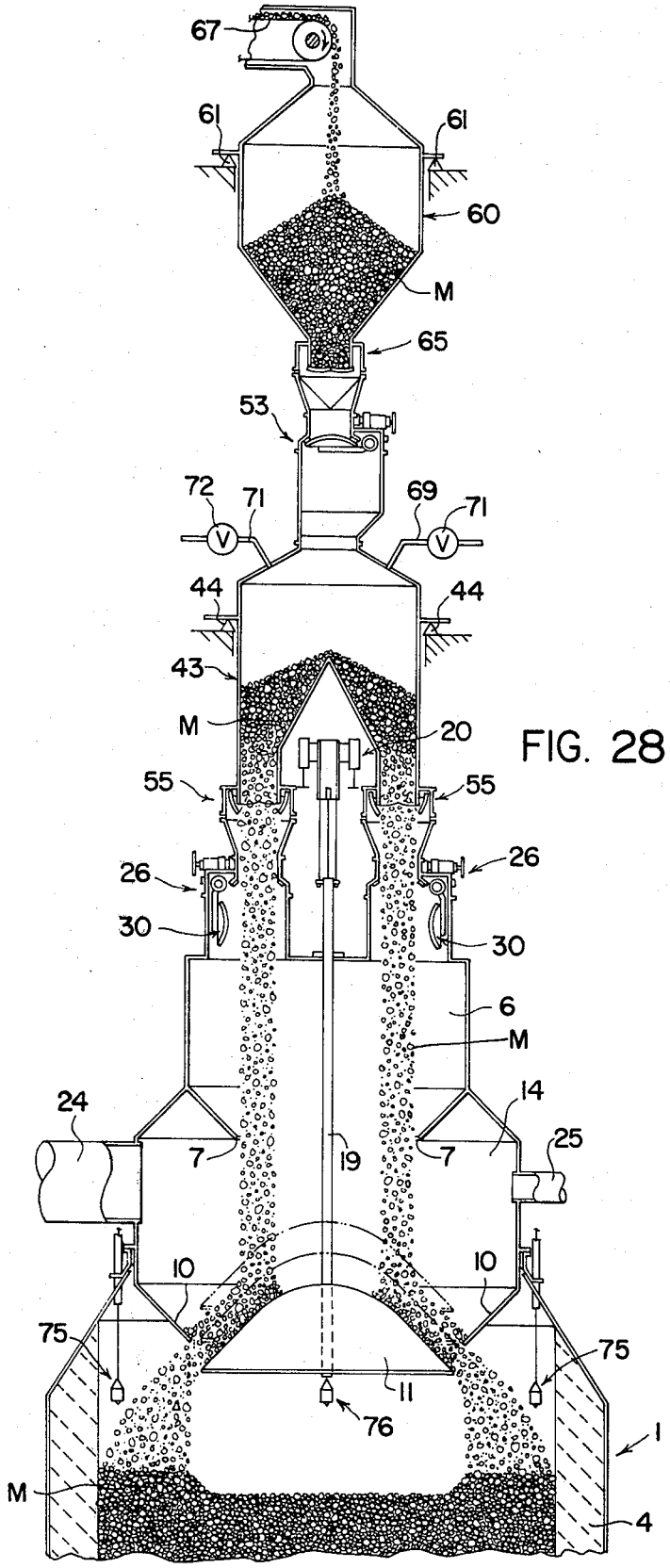
Figure 29:
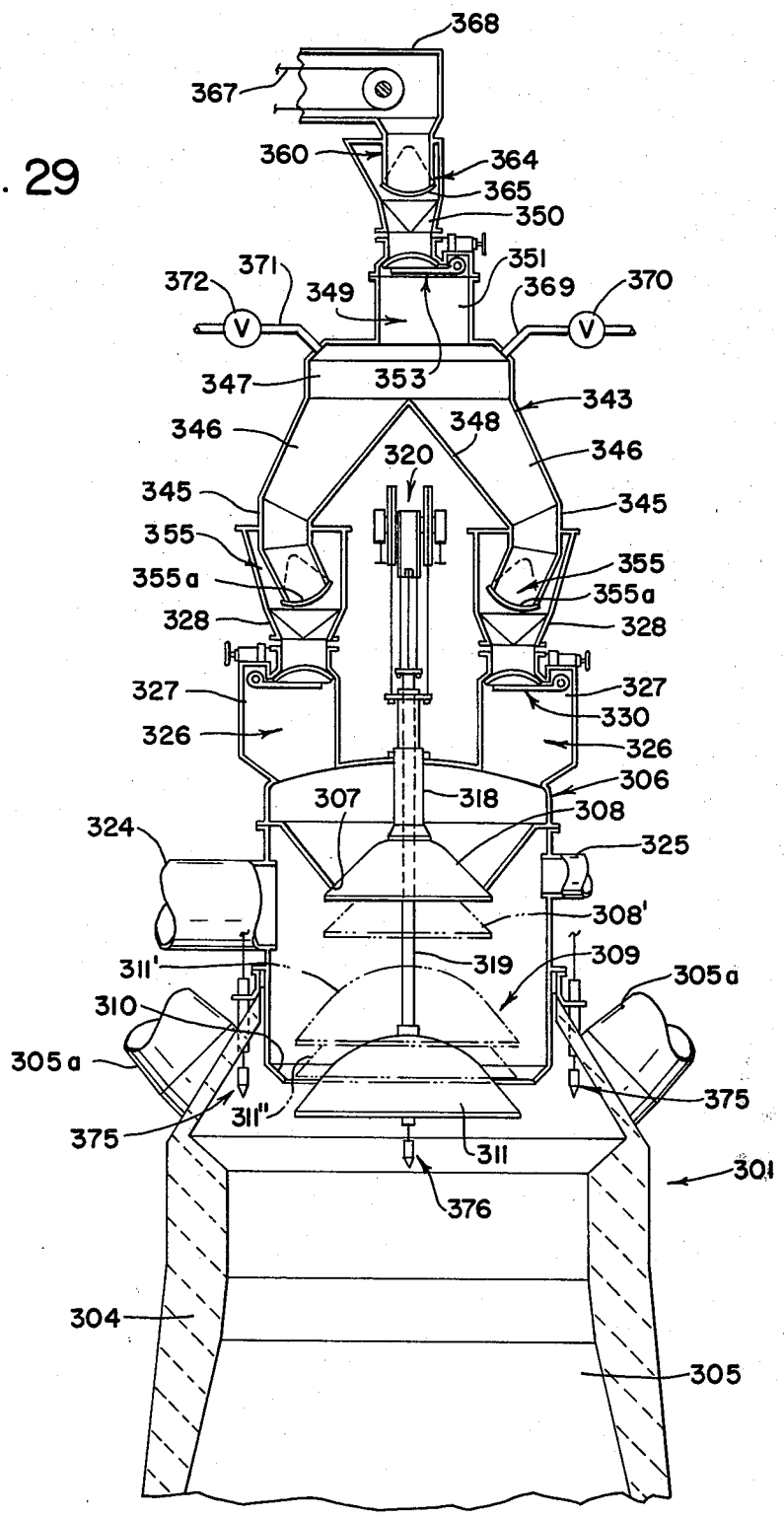
Figure 30A:
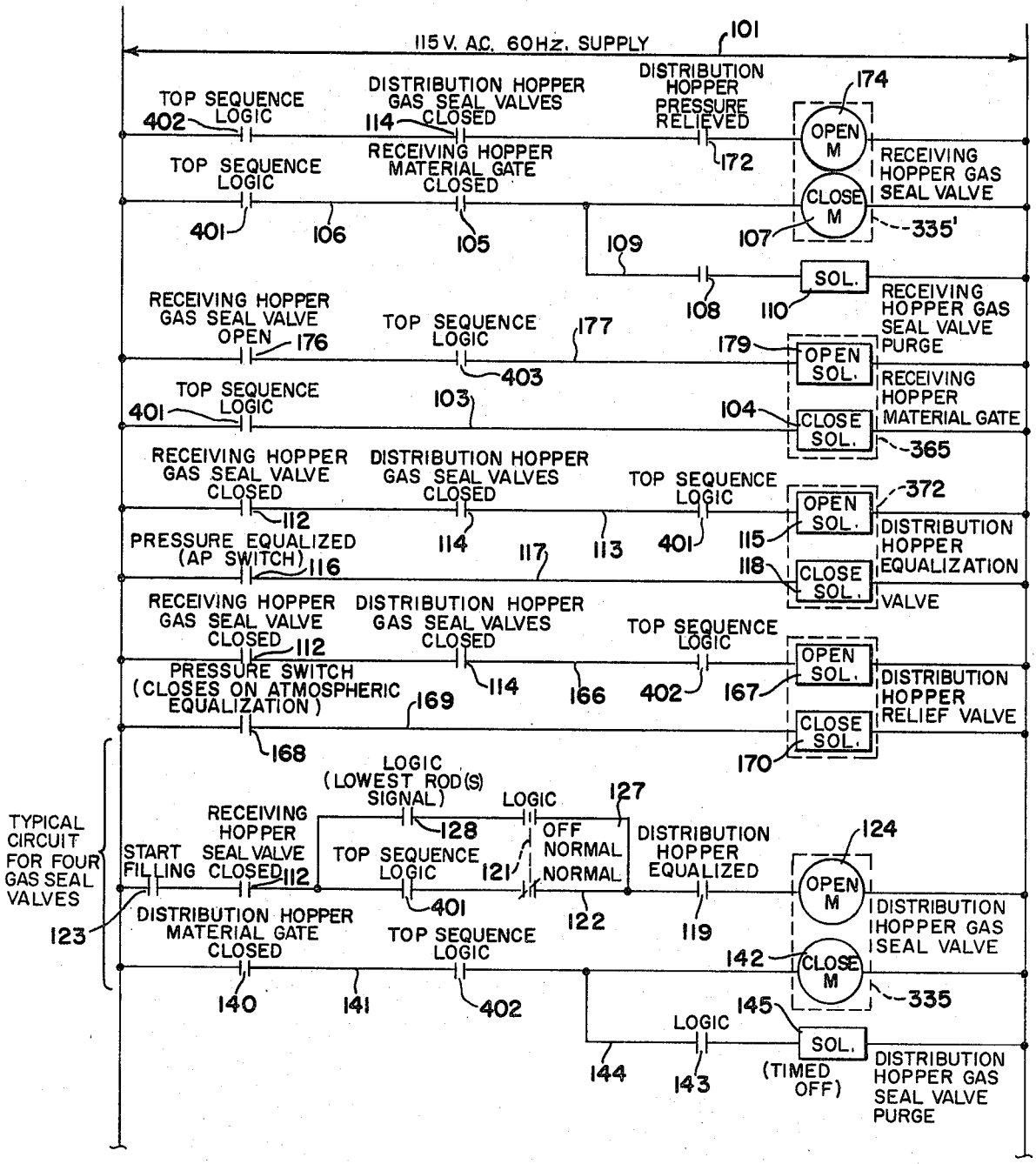
Figure 30B:
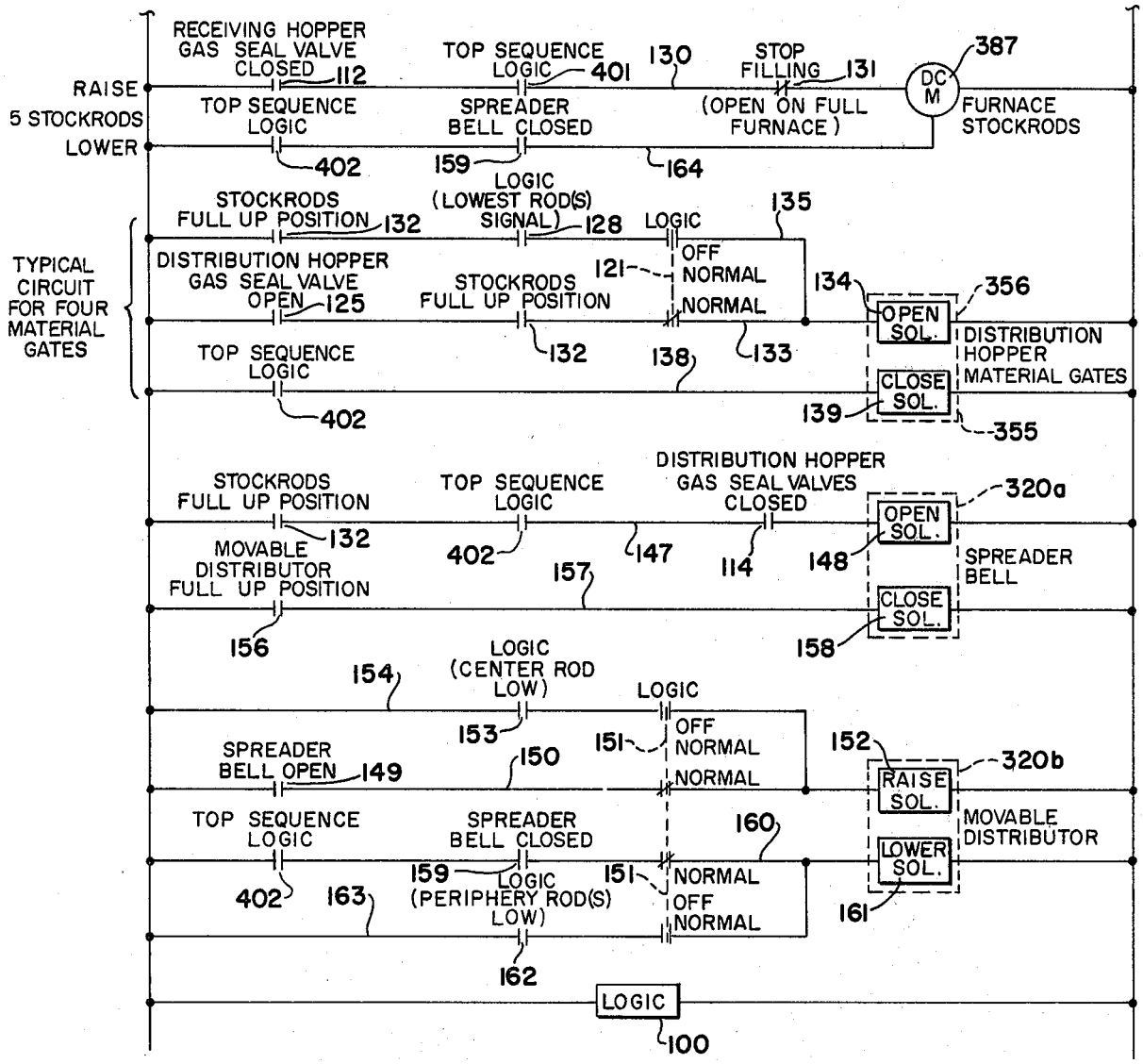

FIG. 13 is a view of the apparatus of FIG. 1 illustrating another method of operation using the control system of FIG. 12;

FIG. 14 is a view of the apparatus of FIG. 1 showing how an abnormal condition in which the load of charge material in the furnace has become lowered in one portion of the stockline can be corrected by the apparatus embodying the invention;

FIG. 15 is a view of the apparatus of FIG. 1 illustrating yet another method of operation;

FIG. 16 is a view of the apparatus of FIG. 1 illustrating another step following the step illustrated in FIG. 15;

FIG. 17 is a view of the apparatus of FIG. 1 illustrating another step following the step illustrated in FIG. 16;

FIG. 18 is a view of the apparatus of FIG. 1 schematically illustrating the segregation and mixing of the larger and smaller particles of charge material;

FIG. 19 is a front elevational view, partially sectioned, of a test model charging apparatus used to demonstrate the advantages of the invention;

FIG. 20 is a side elevational view of the test model apparatus of FIG. 19;

FIG. 21 is a sectional plan view taken along line 21—21 of FIG. 19;

FIG. 22 is another sectional plan view taken along line 22—22 of FIG. 19;

FIG. 23 is a plan view of the sampling receptacle to a larger scale than FIG. 19;

FIG. 24 is a section along line 24—24 of FIG. 23;

FIG. 25 is a detail to a larger scale of two of the sampling cylinders;

FIG. 26 is an illustrated table showing the results of the tests conducted using the test model charging apparatus;

FIG. 27 is a view of the apparatus of FIG. 1 indicating the dimensions of various design parameters;

FIG. 28 is a view similar to that of FIG. 1 and to the same scale illustrating a modification of the apparatus of FIG. 1;

FIG. 29 is a view similar to that of FIG. 1 illustrating another version of the charging apparatus used in a blast furnace; and FIGS. 30*a* and 30*b* are schematic views similar to FIGS. *7a* and *7b* showing an electrical circuitry and logic system for controlling the apparatus of FIG. 29.

DESCRIPTION OF PREFERRED EMBODIMENT

FIGS. 1 to 18 disclose a vertical oil shale retort or shaft furnace 1 of otherwise known construction comprising one form of charging apparatus embodying the invention. The furnace has an upper portion 2 comprising a metal shell 3 of generally circular cross section having an inner lining 4 defining a retorting chamber 5 of generally circular cross section in which is disposed a body of oil shale O having an upwardly facing surface or stockline S. The charging apparatus comprises an internal stationary bell hopper 6 of generally circular cross section having a bottom opening 7 of circular cross section adapted to be closed and opened by vertically movable circular cross sectioned spreader bell 8 which holds charge material in hopper 6 when closed, as shown in full lines in FIG. 1, and which permits charge material to drop out of the hopper when opened, as shown in broken lines 8' in FIG. 1. The bottom edge portion or perimeter of bell 8 extends a substantial distance beyond the edge of hopper opening 7 to provide a desirable spreading effect in charge material passing through opeing 7, as described later.

Spreader bell 8 serves primarily to spread or distribute charge material and, as part of bell hopper 6, to temporarily store the charge material. Bell 8 need not make a gas sealing engagement with bottom opening 7 since a separate gas lock means is elsewhere provided in the apparatus as hereinafter described.

Charge distributor means 9 is located in the upper portion of the furnace below the hopper 6 and bell 8; it comprises a stationary outer distributor member 10 and a movable inner distributor member 11. Member 10 has an inwardly and downwardly converging preferably frustoconical inner surface 12 terminating at its upper end in a generally vertical wall 13 of generally circular cross section to define a chamber 14, and at its lower end in a bottom opening 15 of circular cross section. Member 11, which is of circular cross section, has a lower maximum perimeter portion 16 and an upwardly inwardly converging top surface 17, and is mounted for movement in an upright path extending between a lowermost position in which member 11 has its lower portion 16 and surface 17 substantially below opening 15 as shown in full lines in FIG. 1, and an uppermost position in which member 11 has its lower portion 16 and surface 17 substantially above the opening 15 in the portion of chamber 14 having converging surface 12, as shown in the upper broken lines 11' in FIG. 1. Hopper 6, bell 8, distributor members 10 and 11, and openings 7 and 15 are concentric about the axis A of the furnace in the illustrated embodiment, as is preferable. The generally annular space of clearance C between the perimeter portion 16 of the inner member 11 and the opening 15 of outer member 10 is large enough to permit member 11 to pass freely through the opening but small enough to restrict movement of the charge material through the opening when member 11 is positioned with its lower portion 16 substantially in opening 15 of the hopper, as shown in broken lines 11" in FIG. 1.

Distributor members 10 and 11 distribute the charge material into chamber 5 but unlike members in many conventional charges, they need not necessarily serve as a storage hopper or a gas sealing means since the apparatus contains sufficient gas lock means and storage hoppers elsewhere. Therefore, the clearance C between bottom opening 15 and perimeter portion 16 need not be dimensioned with tolerances sufficient to establish a tight seal therebetween to hold gas pressure or small particles.

Bell 8 is supported, lifted and lowered by a tubular rod 18, and distributor member 11 is supported, lifted and lowered by rod 19 extending axially through rod 18. The bell 8 and member 11 may be nonrotatable but if desired either may be rotated, when bell 8 is free of its hopper, to equalize wear. Known means 20 are provided for actuating rods 18 and 19 as required. Means 20 include spreader bell actuating means 20*a* for moving tubular rod 18 to open and close lower bell 8, and distributor member actuating means 20*b* for moving rod 19 to raise and lower member 11. Means may also be provided for rotating bell 8 and member 11, if desired. Top wall 22 closing the furnace has known sealing means 23 operating between rods 18 and 19 and between rod 18 and wall 22 to prevent escape of gas.

Conduits 24 and 25 open into the upper portion 2 of the furnace above stockline S to permit removal of vapors and gases produced as a result of the retorting or other operation.

The top wall 22 of the furnace has a plurality of port means 26 disposed around axis A and fixed gas-tight to wall 22, four such port means being provided in the illustrated embodiment (FIG. 2). Each port means comprises a housing portion 27 having an upper conduit portion 28, all of which are of the same size and equidistant from and preferably equiangularly spaced around axis A. Each housing portion 27 includes a gas sealing valve 30 (FIGS. 1–3) adapted to close and open the lower end of conduit 28 of each port means 26. Each valve 30 comprises a stationary valve seal 31, preferably formed as shown of heat resistant resilient material, and an upwardly convex movable closure member 32 pivotally mounted on an offset arm 33 fixed to a horizontal rotatable shaft 34 that extends outwardly of housing portion 27 and is sealed against gas leakage. Shaft 34 is rotated as required by actuating means 35 of known construction, to move closure member 32 against the seat 31 to close the valve, and to move member 32 to the open position shown in broken lines 32' in FIG. 3, to open the valve. If desired, the valve seat (as shown) may have apertures 36 through which pressurized gas may be supplied from pipes 38 and 39 to keep the seating portions of valve seat 31 and closure members 32 free of obstructions that can impair sealing.

The arrangement including offset arm 33 is such that, when closure member 32 is closed as shown in FIG. 1, it closes conduit portion 28 and provides a gas tight seal even if there should be substantial gas pressure in the furnace, the gas pressure acting on the closure member to aid in keeping the valve closed tight. When arm 33 is turned to the position shown in broken lines (FIG. 3), all portions of the valve completely clear the flow passage and permit an uninterrupted and unimpeded flow of charge material through port means 26 into bell hopper 6. Doors 41 and 42 are provided to permit access to the interior of housing portion 27 and to member 32 and arm 33 for maintenance.

Usually each valve 30 is operated in unison with the other valves 30 although each valve may be operated independently of the other valves when desired. The actuating means 35 is electrically controlled by suitable control means such as that described later. Known monitoring means are included for sensing the position of each closure member 32 to determine whether each valve 30 is opened or closed, which information is sent from the monitoring means to the control means.

A temporary storage or distribution hopper 43 mounted immediatedly above the port means 26 is supported for limited vertical movement in a fixed path by a plurality of known load cells 44, preferably three load cells, diagrammatically shown in known supporting means. The load cells 44 are adjustable to provide electrical signals when the hopper 43 has a predetermined weight of charge material deposited therein at a weight set point, and when the hopper 43 is empty of charge material, such signals being utilized by suitable control means such as that described later.

Distribution hopper 43 is not rotatable, and is thus unlike similarly located hoppers of conventional charging apparatus, and therefore avoids the problems associated with rotatable hoppers.

Hopper 43 has a plurality of downwardly extending legs 45 equal in number to the port means 26, each adapted to discharge into one of the port means, there being four such legs in the illustrated embodiment. Each leg is generally cylindrical in cross section and at its lower portion opens through an upwardly widening transition portion 46 into a generally cylindrical upper hopper portion 47, the transition portion having a generally conical central dividing wall portion 48 coaxial about axis A.

Hopper 43 is fed from an entrance port means 49 having a conduit portion 50 located coaxially of axis A. The relatively small cross-sectional area of port means 49 and conduit portion 50 relative to the cross-sectional area of dividing portion 48 provides a choked feed of charge material into hopper 43 so that material discharged through conduit 50 drops onto the conical dividing portion 48 and is divided and distributed in substantially equal amounts to each of legs 45. The distribution of particle sizes in the material dropping through conduit 50 is not uniform, since the smaller or fine particles tend to segregate toward the axial center of the conduit. Although the fed material has a nonuniform size distribution, the distribution is generally symmetrical about the central axis A, and conical dividing portion 48 provides substantially equal particle size distributions to each of legs 45 since portion 48 is also coaxial with conduit 50 along axis A, so that the fine particles segregated toward the center strike the top of conical portion 48 and are substantially equally divided into each leg.

The port means 49 is similar to each individual port means 26 at the upper portion of the retort in that it comprises a housing portion 51 embodying conduit portion 50 and gas sealing valve 53 similar to valve 30 described above and comprising valve seat 31' and a closure member 32' adapted to be opened and closed by actuating means 35', the position of the closure member being monitored by known means.

The lower portion of each leg 45 of hopper 43 has fixed to it an enlarged cylindrical portion 54 internally supporting a material holding gate 55, comprising a pair of pivotally mounted cooperating closure members **55*a* and 55*b* (FIGS. 1, 4) adapted by suitable known actuating means 56 to be closed to hold charge material in hopper 43 and opened to permit discharge of charge material from the hopper through the associated leg 45 of the hopper. The actuating means 56 are controlled by electrical signals from suitable control means such as that described later. Monitoring means are provied to sense whether material gate 55 is open or closed and to relay this information to the control means. The gates for all leg portions are usually opened and closed in unison; however, the gate for each individual leg is adapted to be opened and closed individually when desired. The lower portion 54 of each leg and the upper portion of the conduit portion 28 of each port means 26 are joined by a known expansible and contractable sealing means 57 to provide a gas tight seal between the hopper 43 and the several port means 26 while permitting suitable movement of the hopper 43** relative to the port means when the hopper moves in an upright path in response to the load in the hopper.

A receiving hopper 60 is also supported by known means above hopper 43 by a plurality of known load cells 61, preferably three load cells, for limited movement in an upright path. Hopper 60 is preferably of cylindrical cross section at its central portion 62 and has a lower conical portion 63 terminating in a discharge portion 64 containing a gate 65 similar to each of gates 55, comprising pivotally mounted members **65*a* and 65*b* that cooperate to close and open the bottom of the hopper and permit charge material within the hopper to be held in hopper 60 or to be discharged through port means 49 into hopper 43 as required after gas sealing valve 53 is opened. The discharge portion 64 of hopper 60 is connected to the port means 49 of hopper 43 by suitable flexible sealing means 66** that permit limited vertical movement of the hoppers relative to each other while preventing the escape of dust or gases.

In the illustrated apparatus, a belt conveyor 67 is provided to discharge particulate oil shale material continuously into hopper 60, the conveyor being enclosed in a suitable housing 68 to prevent escape of undesirable gases or dust.

Temporary storage or distribution hopper 43 also has a conduit 69 controlled by valve 70, to permit discharge of gas from the interior of the hopper 43 to relieve the pressure in the hopper to that of the atmosphere before the gas sealing valve 53 and gate 65 at the upper portion of the hopper are open to permit charge material to drop into hopper 43 while gates 53 and gas sealing valves 30 are closed. An atmospheric pressure switch is connected to hopper 43 to sense when the pressure within the hopper has reached atmospheric level and to then close valve 70. Hopper 43 also has another conduit 71, controlled by a valve 72, to permit suitable gas to be introduced into the interior of hopper 43 to raise its internal pressure to that of the gas pressure in the furnace after the gate 65 and gas sealing valve 53 have been closed and before any of the lower gas valves 30 and gates 55 have been opened to permit discharge of charge material from hopper 43 into the hopper portion 6 of the furnace 1. Means are also provided to sense when the pressure in hopper 43 has been equalized with the pressure in the furnace.

From the above, it is apparent that the above described valve containing portions of hoppers 43 and 60 and port means 26, in combination with hopper 43 itself provide gas lock means permitting charge material to be introduced from receiving hopper 60 into distribution hopper 43 and from distribution hopper 43 into bell hopper 6 in the furnace without undesired loss of vapors or gas from within the furnace by suitable actuation of the above described gas sealing valves 30 and 53 of material holding gates 55 and 65, and gas relief and pressurizing valves 70 and 73.

Figure 5:
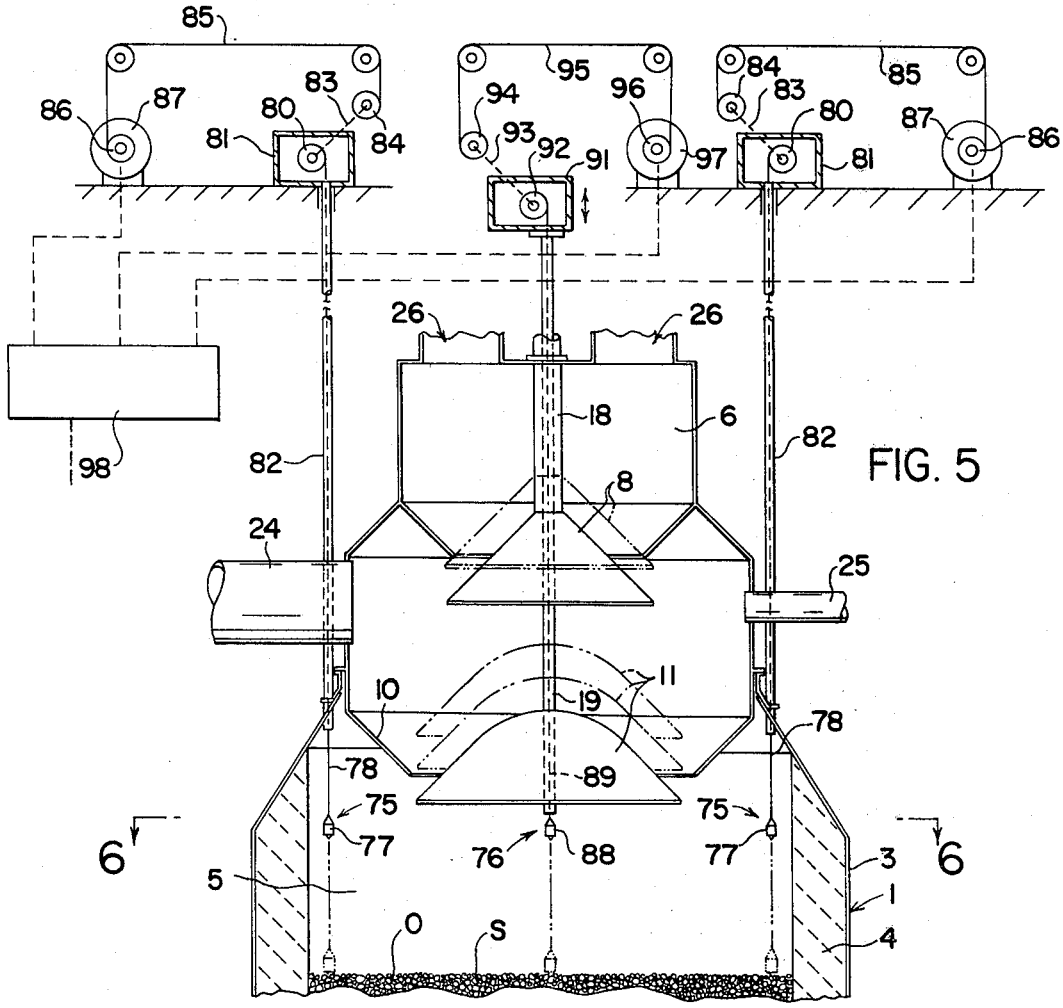
FIG. 5 is a diagrammatic view of a portion of the retort showing means for raising and lowering stock rods.
Figure 6:
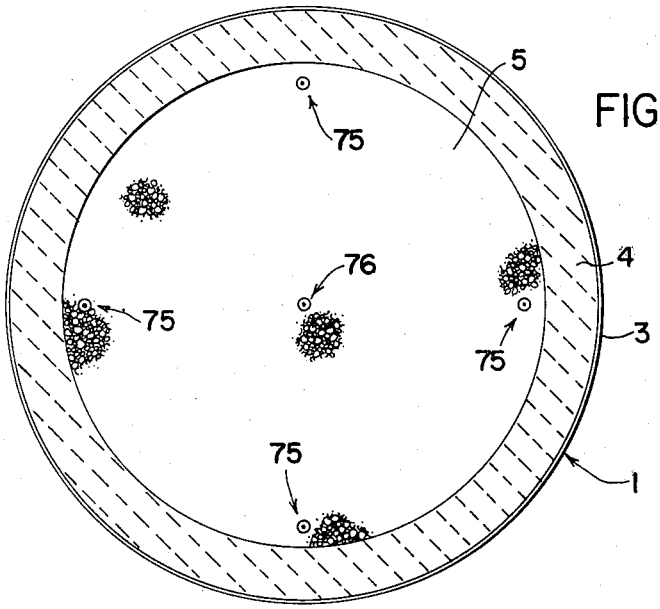
FIG. 6 is a section along line 6—6 of FIG. 5.

To control the position or movement of the distributor member 11 and to control the feed of charge material into the furnace 1 to achieve a desired stockline height and level, stockline sensing means, as illustrated in FIGS. 1, 5 and 6, may be used. The sensing means includes a plurality of outer stockline level sensing devices 75, four such devices being shown in the illustrated embodiment, equidistantly and equiangularly spaced to determine the height of the stockline near the outer periphery of the stockline in the furnace. There is also another stockline level sensing device 76 located substantially coaxially of the furnace to check the height of the stockline centrally of the furnace. More specifically, each stockline sensing device 75 may be a known stock rod, comprising a sensing member 77 of substantial weight and preferably having a conical bottom, which is supported by a steel cable 78 adapted to be wound on and unwound from a winch drum 80 mounted in a gas-tight housing 81 that communicates with the retort chamber 5 through vertical tube 82. Therefore, member 77, its cable 78 and its winch drum 80 are at all times exposed to the pressure of gas in the furnace. Each winch drum 80 is mounted on a shaft 83 extending through a wall of housing 81 through a known sealing means that prevents escape of gas past the shaft. Each shaft 83 rigidly carries another winch drum 84 adapted to wind on and off the drum another cable 85 that winds on or off a third winch drum 86 driven by sensing motor 87.

Sensing device 76 comprises a sensing member 88 supported by a steel cable 89 extending longitudinally through rod 19 for distributor member 11 which rod is made hollow for the purpose. A housing 91 is mounted on the top of rod 19 and rides up and down with it. The upper portion of cable 89 is wound on a winch drum 92 in housing 91. Drum 92 is fixed on a rotatable shaft 93 extending outside of and sealed to the housing and rigidly carrying a winch drum 94 by which is wound and unwound cable 95 adapted to wind on and off a winch drum 96 mounted on the shaft of a sensing motor 97.

In known manner the sensing members 77 and 88 are usually kept in an upper out-of-the-way location, as shown in FIG. 1, until it is desired to check the stockline level, when the members are lowered by suitable operation of their motors 87 and 97 until the members 77 and 88 contact the charge material in the furnace and stockline, when the motors stop. Information as to the level of the material sensed by each such member is provided by the number of turns on the motor 87 necessary to lower the members to stockline sensing levels. This information can be read out from known indicating means 98 and used to control the operation of the charging apparatus, including the passage of charge material into the receiving and distribution hoppers, to provide charging and distribution of charge material to provide a stockline of desired height and shape, such as a substantially level stockline. Moreover, the information supplied to indicating means 98 is also supplied to a logic unit 100 (FIG. 7) which provides automatic programmed control of the charging operation as described below.

Figure 7A:
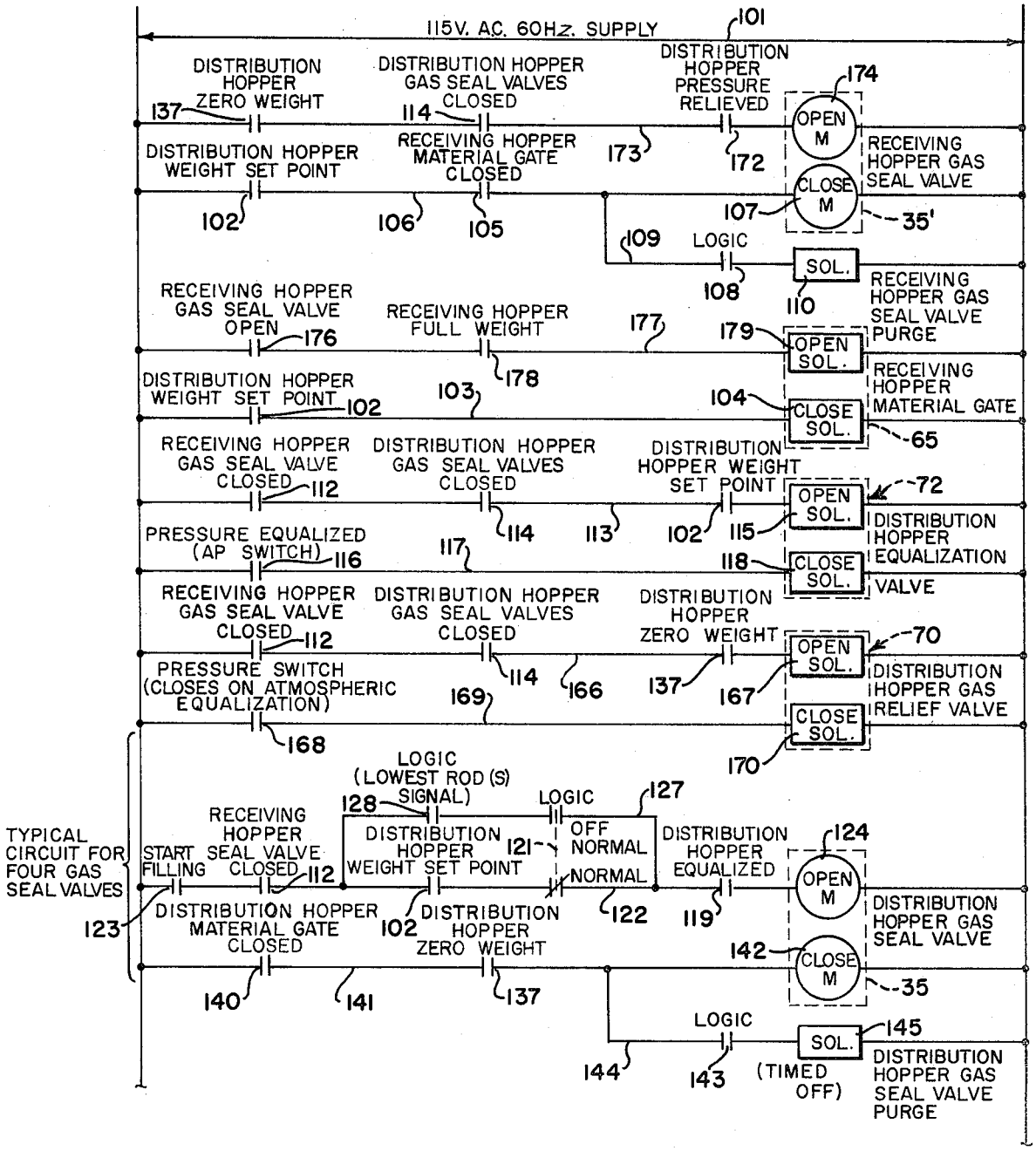
Figure 7B:
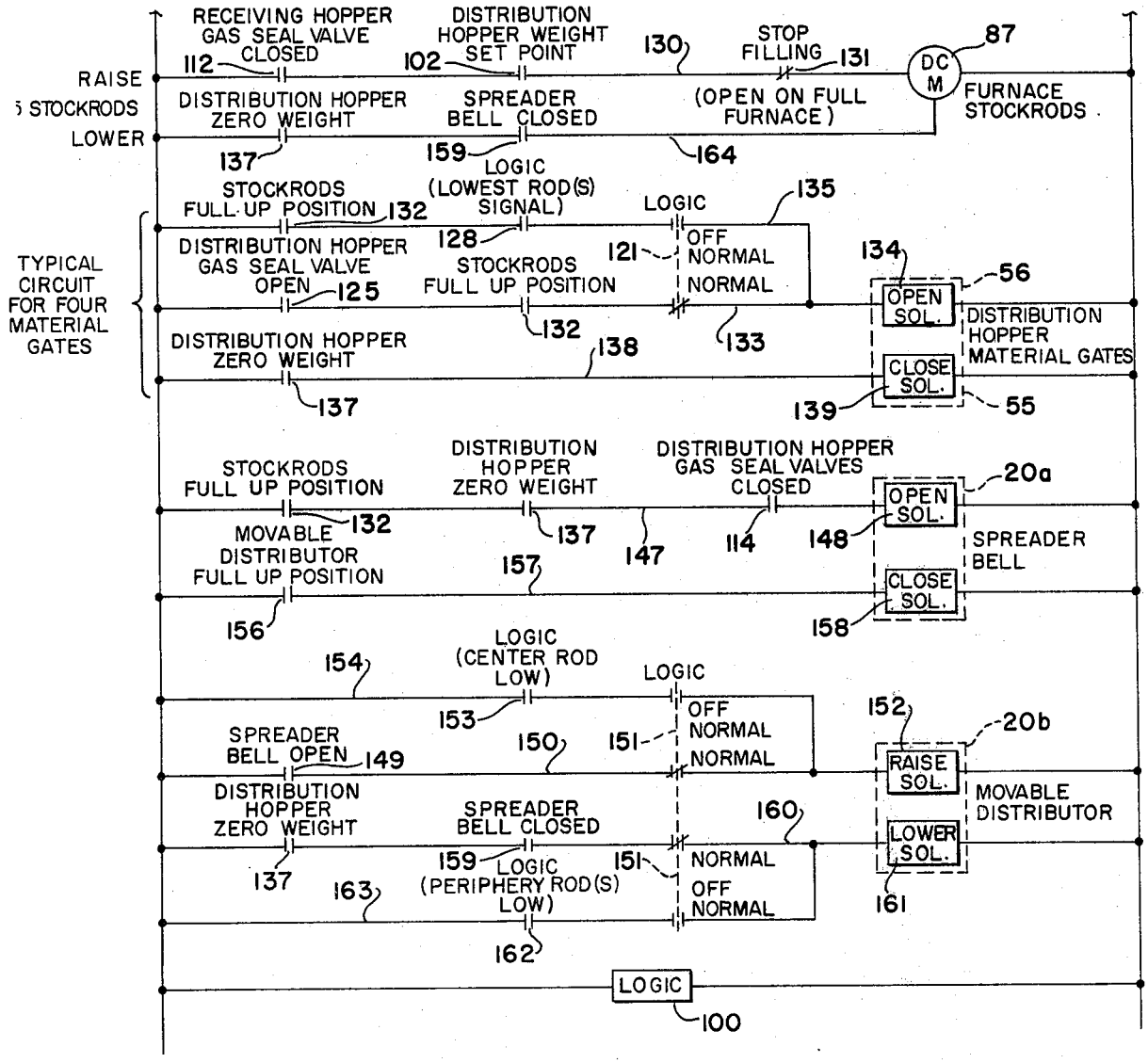

FIG. 7 illustrates preferable circuit means and circuit elements for controlling the apparatus previously illustrated in accordance with the preferred method, as well as other methods, of operation. The preferred control circuit means operates with a conventional electrical power supply 101. The control means includes a plurality of open and close contacts each of which is actuatable by the output of one of various elements in the apparatus or by the control of logic unit 100. Logic unit 100 may be a microprocessor or minicomputer of known design, and may include suitable programmable read only memories (PROM) to provide control signals to actuate various contacts and switches identified in FIG. 7 by the word "logic". Logic unit 100 is connected to each of these "logic" controlled contacts and switches by suitable control lines (not shown).

The distribution hopper load cells 44 activate open contacts 102. When distribution hopper 43 is filled to a predetermined weight, load cell 44 provide a "weight set point" signal that closes various contacts 102, including one on line 103. The closing of contact 102 on line 103 allows current to reach solenoid 104 of the receiving hopper material gate actuating means which closes gate 65. When gate 65 is closed, the monitoring means associated with the gate produces a signal which closes contact 105 on line 106. The closing of contacts 102 and 105 on line 106 completes the circuit which actuates motor 107 of actuating means 35', closing receiving hopper gas sealing valve 53. As valve 53 closes, contact 108 on line 109 is closed by logic unit 100 to actuate solenoid 110 which allows pressurized gas to be supplied through pipes 38 and 39 to clear seat 31 and closure members 32 of valve 53 (FIG. 3). Solenoid 110 includes a timing mechanism to automatically close after a predetermined time delay. When valve 53 has been closed, the monitoring means for the valve directs the closing of contact 112 on line 113. Assuming that the distribution hopper gas sealing valves 30 are closed, contacts 114 will also be closed.

The closing of contacts 102, 112 and 114 allows current to travel on line 113 to solenoid 115 on distribution hopper equalization valve 72. Valve 72 remains open until the pressure sensing means in hopper 43 determines that the pressure in the hopper has been equalized with the pressure in the chamber, at which time the appropriate command is sent to close contact 116 on line 117 which energizes solenoid 118 to close the valve. The pressure sensing means in hopper 43 also closes contacts 119 on each of the distribution hopper gas sealing valve opening circuits. Since the circuit for each of the four valves is identical, only one such circuit is shown in FIG. 7.

If the charging apparatus is operating normally, logic unit 100 will maintain logic controlled switches 121 in the "normal" position, so that the circuit on line 122 is closed. With contacts 102, 112, and 119 on line 122 closed, and upon the actuation of a "start filling" signal, closing contact 123, current is provided on line 122 to cause motor 124 of actuating means 35 to open each of the four distribution hopper gas sealing valves 30. When all four valves 30 have been opened, the monitoring means associated with the valves provides an output which closes contacts 125.

If the charging apparatus is not operating normally, logic unit 100 throws switch 121, opening the circuit on line 122 and closing the circuit on line 127. Logic unit 100 may then provide the appropriate signal to close contact 128 on line 127 if the stock rods indicate that the stockline has reached a predetermined low level. Current will then pass on line 127 to actuate motor 124 and open each of the four distribution hopper gas seal valves 30 even if distribution hopper 43 is not full.

The five furnace stock rods 75 and 75 are raised when current is provided over line 130 to motor 87. The circuit on line 130 is closed with the closing of contacts 102 and 112 and without the opening of contact 131, which occurs if there is no "stop filling" signal. Contact 131 is opened when the furnace is full and further charging should be prevented. When the stock rods are fully raised, indicating means 98 signals the closing of contacts 132.

When the charging apparatus is operating normally and switch 121 is in its "normal" position, the closing of contacts 125 and 132 completes the circuit on line 133, causing solenoid 134 of actuating means 56 to open the distribution hopper material gates 55. Gates 55 may also be opened if switch 121 has been placed in its "off normal" position by logic unit 100 when contact 128 on line 135 is closed, indicating that the stockline has reached a predetermined low level, and when contact 132 is closed indicating that the stock rods are in their "full up" position. With gates 55 open, material is discharged from distribution hopper 43 until it is empty.

When distribution hopper 43 has emptied, load cells 44 indicate "zero weight" which actuates the closing of various contacts 137. The closing of contact 137 on line 138 allows current to reach solenoid 139 of actuating means 56 which closes the distribution hopper material holding gates 55. When all gates 55 are closed, the monitoring means sends the appropriate signals to close contact 140 which completes the circuit on line 141, causing motor 142 of actuating means 35 to close the distribution hopper gas sealing valves 30. As valves 30 are closed, contact 143 on line 144 is closed by logic unit 100 to actuate solenoid 145 which allows pressurized gas to be supplied through pipes 38 and 39 to clear seal 31 and closure members 32 of each valve 30. Solenoid 145 includes a timing mechanism to automatically close after a predetermined time delay. The closing of valves 30 triggers the valve monitoring means which close contacts 114.

The closing of contacts 114, 132 and 137 on line 147 actuates solenoid 148 of actuating means **20*a* to open spreader bell 8. The opening of bell 8 causes contacts 149 on line 150 to close. When the charging apparatus is operating normally and a level stockline is being produced, logic unit 100 maintains switches 151 in their "normal" position. With switch 151 in its "normal" position and contact 149 closed, current is provided over line 150 which causes solenoid 152 of actuating means 20*b* to raise movable distributor member 11 at a rate controlled by the logic unit. Member 11 may also be raised if logic unit 100 moves switch 151 to its "off normal" position and closes contact 153 on line 154. Contact 153 is closed by the logic unit when periphery stock rods 75 indicate a lower stockline level than center stock rod 76**.

If desired, a time delay may be incorporated into the closing of contact 149 so that distributor member 11 does not begin moving upwardly until a predetermined period of time after spreader bell 8 has been opened. It has been found that such a delay is desirable in achieving a level stockline around the outer periphery of the furnace. The length of that delay will vary depending upon the material being charged, for example, 8 seconds for oil shale, 5 seconds for coke, 6 seconds for sinter, and 4 seconds for pellets, using the test model charging apparatus, as hereinafter described.

Movable distributor continues to rise until it reaches its uppermost position which causes contact 156 on line 157 to close. The closing of contact 156 actuates solenoid 158 of actuating means **20*a* which closes spreader bell 8. When bell 8 is closed, contacts 159 close. With contacts 137 and 159 closed and with logic unit 100 maintaining switch 151 in its "normal" position, current is provided over line 160 to solenoid 161 causing movable distributor member 11 to be lowered. Member 11 may also be lowered if logic unit 100 moves switch 151 to its "off normal" position and closes contact 162 on line 163. Contact 162 is closed by the logic unit when center stock rod 76 indicates a lower stock level than periphery stock rods 75**.

The closing of contacts 137 and 159 on line 164 also actuates motor 87 to lower stock rods 75 and 76 to measure the stockline and to provide the appropriate information to logic unit 100.

With contacts 112, 114 and 137 on line 166 closed, current passes to solenoid 167, opening relief valve 70, which relieves the pressure within distribution hopper 43 to atmospheric level. Valve 70 is closed upon the sensing of atmospheric pressure in hopper 43 by the atmospheric pressure switch in the hopper which closes contact 168 on line 169 actuating solenoid 170. The pressure switch also provides a signal which closes contacts 172. The closing of contacts 114, 137 and 172 on line 173 actuates motor 174 of actuating means 35' which opens receiving hopper gas sealing valve 53. When valve 53 has been opened, the valve monitoring means close contact 176 on line 177. When load cell 61 indicates that receiving hopper 60 is filled, a "full weight signal" closes contact 178 on line 177. The closing of contacts 176 and 178 actuates solenoid 179 which opens the receiving hopper material gate 65.

A preferred method of operation of this invention can now be described with reference to the control circuitry of FIG. 7 and to the points of operation of the apparatus illustrated in FIGS. 8–11. It is assumed that the furnace is actively in operation, has been filled to its desired full level with charge material M, and is waiting for resumption of a charging signal. The stock rods 75 and 76 have been lowered to the furnace stockline. Charge material is continuously discharged into receiving hopper 60 by conveyor 67. It is further assumed that movable distributor member 11 is in its lowermost position and that spreader bell 8 is closed. Material holding gate 65 and gas sealing valve 53 are open, and distribution hopper 43 is being filled with charge material.

When hopper 43 has been filled to a predetermined weight (FIG. 8), a "weight set point" signal from load cells 44 closes contacts 102 actuating solenoid 104 and closing material holding gate 65. The closing of gate 65 closes contacts 105, which together with the closing of contact 102 on line 106 actuates motor 107 to close gas sealing valve 53. As valve 53 closed, logic controlled contact 108 is closed actuating solenoid 110 to purge the seat of valve 53 by inert gas from apertures 36 so that the valve seat 31 is clear of any foreign matter. With the closing of valve 53, contact 112 closes, which together with the closing of the "weight set point" contact 102 and "distribution hopper gas seal valves closed" contact 114 on line 113 actuates solenoid 115 to open the distribution hopper purge equalization valve 72. The gas pressure in hopper 43 is equalized to the furnace top gas pressure by introduction of gas through conduit 71 and its valve 72. Valve 72 will close automatically when the pressure is equalized upon the closing of contact 116. Receiving hopper 60 which receives charge material continuously can be filled to its full set-point weight as sensed by load cells 61, and upon achievement of the full weight in receiving hopper 60, contact 178 will close.

At the same time that valve 72 is opened and the pressure in distribution hopper 43 begins to be equalized, the closing of contacts 102 and 112, together with the absence of a "stop filling" signal which would open contact 131 on line 130, causes stock rods 75 and 76 to be raised to their uppermost position, resulting in the closing of contacts 132.

After the pressure in distribution hopper is equalized and contact 119 is closed, under normal operation of the apparatus as indicated by the maintenance of switches 121 in the "normal" position, with distribution hopper 43 full, the closing of "weight set point" contact 102 and "pressure equalization" contact 119 and "receiving hopper gas seal valve closed" contact 112 on line 122 will cause motor 124 of actuating means 35 to open all four electrically operated gas sealing valves 30 of distribution hopper 43. The opening of gas sealing valves 30 initiates the closing of contact 118 on line 126, which together with the closing of "furnace stock rod full up" contact 132, and the maintenance of switch 121 in its "normal" position causes the four hydraulically operated distribution hopper material gates 55 to be opened by solenoids 134 of actuating means 56. Charge material M is then discharged from distribution hopper 43 through the four port means 26 into bell hopper 6 (FIG. 9).

When distribution hopper 43 has been emptied, load cells 44 supporting hopper 43 will indicate zero weight of charge material in the hopper, closing contacts 137. The closing of contact 137 on line 138 will actuate solenoid 139, causing material holding gates 55 to close.

Immediately after material holding gates 55 have been completely closed, contact 140 on line 141 will close and gas sealing valves 30 will be closed by motor 142. The closing of valves 30 will close contact 114 on line 147 where contacts 132 and 137 are already closed. Solenoid 148 will open spreader bell 8 to cause the charge material in bell hopper to be spread evenly onto distributor member 10 (FIG. 10). Bell 8 may be lowered either rapidly or slowly as desired. The substantially larger cross section of the hopper portion of bell 8 as compared to the cross section of the opening 7 in bell hopper 6, together with the upwardly inwardly converging surface of the bell, promotes a desirable wide spreading action.

After bell 8 is opened, contact 149 on line 151 closes, causing solenoid 152 of actuating means **20*b* to raise distributor member 11 at a predetermined rate of speed through the charge material flowing downwardly from hopper 6 into and through distributor member 10, causing a change in configuration of the angular clearance C between the distributor members 10 and 11. The resultant change will cause charge material to distribute in a level layer extending from the periphery of the retort or furnace to the center of the stockline under member 11 (FIG. 11). As previously discussed, the initiation of the upward movement of distributor member 11 may be suitably delayed to allow material to reach member 11 from the hopper 6 and to allow the outer periphery of the furnace chamber 5** to receive a sufficient amount of material.

When distributor member 11 reaches its uppermost position, contact 156 closes, causing solenoid 158 to close spreader bell 8. With contact 137 already closed, the closing of bell 8 closes contacts 159 on lines 160 and 164, which simultaneously actuates solenoid 161 to return distributor member 11 to its lower position with switch 151 in its "normal" position, and actuates motor 87 to lower stock rods 75 and 76 to the stockline of the charge material in the furnace. The position of the stock rods will then be indicated by logic unit 100 by indicating means 98.

After distribution hopper gas sealing valves 30 has been closed and while charge material is being discharged from bell hopper 6 onto the upwardly moving distributor member 11, distribution hopper 43 is returned to atmospheric pressure in preparation for receiving more charge material from receiving hopper 60. With valve 53 closed and hopper 43 empty, the closing of valves 30 causes contact 114 to close which actuates solenoid 167 to open relief valve 70 and relieve the internal pressure in distribution hopper 43 to atmospheric pressure. After such relief has caused contacts 172 on line 173 to close, and while contacts 114 and 137 are closed, motor 174 of actuating means 35' opens the receiving hopper gas sealing valve 53, causing contact 176 to close. Upon attainment of full weight in receiving hopper 60 as measured by load cells 61, contact 178 on line 177 closes, so that material holding gate 65 is opened by solenoid 179. Material in receiving hopper 60 then flows into distribution hopper 43 as shown in FIG. 8. When load cells 44 indicate that distribution hopper 43 contains a predetermined full weight of charge material, material holding gate 65 closes, the gate being capable of closing against flow of material if required. After gate 65 is closed, the gas sealing valve 53 is also closed when contact 105 closes. After valve 53 is closed, gas equalizer valve 73 is opened with the closing of contact 112 to allow entrance of pressurized gas into distribution hopper 43 to bring the interior of the hopper to furnace pressure.

If load cells 44 do not yet indicate that the distribution hopper 43 has reached its full weight set point, so that contacts 102 remain open, logic unit 100 may still initiate charging upon an indication from stock rods 75 and 76 that the stockline has reached a predetermined low level. Logic unit 100 initiates the charging operation by changing switches 121 to their "off normal" position and closing contacts 128 on lines 127 and 135. The closing of contact 128 on line 127, together with the closing of "start filling" contact 123 and "receiving hopper gas sealing valve closed" contact 112 and "purge equalization pressure" contact 119 causes motor 124 to open the distribution hopper gas sealing valves 30 and initiate the charging procedure. Thereafter, the closing of contact 128 on line 135, along with the closing of "stock rods full up position" contact 132 actuates solenoid 134 which opens the distribution hopper material holding gates 55, and allows charging material to be discharged into bell hopper 6.

Under normal conditions, charge material continuously discharges into receiving hopper 60, which then discharges periodically into distribution hopper 43 which in turn as required discharges into furnace 1, as described above, the whole operation operating continuously so long as the retort or shaft furnace is heating and utilizing charge material. However, in the event of an occurrence such that distribution hopper 43 is not yet ready to receive charge material from receiving hopper 60 when it is full, the signal from load cells 61 can be used to halt delivery of charge material to hopper 60, such as by halting operation of conveyor 67.

During operation of the furnace it is possible that an unevenness may occur in the stockline of charge material M in the furnace 1, as due to slips or channeling. If this condition occurs, it will be sensed by stock rods 75 and 76 which can then initiate a special operational sequence by logic unit 100. If logic unit 100 senses that periphery stock rods 75 measure a lower stockline level than center stock rods 76, or if logic unit 100 senses that center stock rod 76 measures a lower stockline level than periphery stock rods 75, the appropriate signals are initiated by logic unit 100 to change switches 151 from their "normal" position to their "off normal" position, thereby opening the circuits on lines 150 and 160 and closing the circuits on lines 154 and 163. If periphery stock rods 75 are lower than center stock rod 76, contact 162 on line 163 is closed by the logic unit and solenoid 161 is actuated to continuously maintain movable distributor member 11 in its lowermost position, to direct charge material to the periphery of the furnace (FIG. 10). If center stock rod 76 is lower than periphery stock rods 75, contact 153 on line 154 is closed by the logic unit and solenoid 152 is actuated to continuously maintain movable distributor member 11 in its uppermost position to direct charge material to the center of the furnace (FIG. 11). Upon correction of the abnormal conditions, logic unit 100 restores the normal sequence of operation by returning switches 151 to their "normal" positions.

The circuitry as illustrated in FIG. 7 includes various controls and checks to maintain the proper flow of charge material through the apparatus without hopper overflow and without undesirable loss of pressure in the furnace. For instance, contact 114 on line 173 assures that the receiving hopper gas sealing valve 53 will open only when the distribution hopper gas sealing valves 30 are closed, and contact 172 on line 173 assures that valve 53 will open only when the pressure in distribution hopper 43 has been relieved to atmospheric level. Similarly, contact 112 on line 122 assures that the distribution hopper gas sealing valves 30 will open only when the receiving hopper gas sealing valve 53 is closed, and contact 119 on line 122 assures that valves 30 will open only when the pressure in distribution hopper 43 is equalized with the pressure in the furnace. Contact 125 on line 133 and contact 176 on line 177 assure that material holding gates 55 and 65 will not open unless their respective gas sealing valves 30 and 53 are open. Because of contact 178 on line 177, the receiving hopper material holding gate 65 only opens to discharge a predetermined amount of charge material from receiving hopper 60 when hopper 60 is full, and because of contact 102 on line 106, gate 65 only closes to stop discharging material into distribution hopper 43 when hopper 43 is full.

Various other controls and checks not shown in FIG. 7 can be incorporated into the circuitry. For example, line 113 may also include a contact 168, so that the distribution hopper purge equalization valve 72 will not be opened unless relief valve 70 is closed, and line 166 may be provided with a contact 119 so that relief valve 70 will not be opened unless equalization valve 72 is closed.

The control circuitry and logic unit shown in FIG. 7 may be simplified, as illustrated by FIG. 12, so that spreader bell 8 remains open at all times and charge material is discharged through port means 26 over bell 8 and onto distributor members 10 and 11 as material holding gate 55 is opened. For this modification, contacts 114, 132, 137 and 156 are removed from lines 147 and 157 and replaced by a switch 181. Using the simplified mode of operation, bell 8 is normally maintained in its down or open position during all phases of operation. When the charging apparatus is operating normally, switch 181 maintains the circuit on line 147 closed, actuating solenoid 148 and opening spreader bell 8. If normal operation is interrupted, switch 165 can be changed to close the circuit on line 157, actuating solenoid 158 and closing bell 8. Since the bell normally remains open, contacts 149 and 159 are eliminated from the circuitry of FIG. 12. On line 150, contact 149 is replaced by a contact 182 which closes when distribution hopper material gates 55 are opened. Valve purge solenoids 110 and 145 and the associated logic controlled contacts 108 and 143 are not shown in FIG. 12, but it is understood that they may be added as shown in FIG. 7.

A typical sequence of operation based upon the control circuitry of FIG. 12 begins with material holding gate 65 and gas sealing valve 53 open so that material is being continuously introduced from receiving hopper 60 into distribution hopper 43. (See FIG. 8). Material holding gates 55 and gas sealing valves 30 are closed, and distribution hopper 43 has been relieved to atmospheric pressure. Spreader bell 8 is lowered so that bell hopper 6 is open. Distributor member 11 is fully lowered. Stock rods 75 and 76 have been fully raised after measuring a predetermined low stockline level, indicating the resumption of charging.

When the weight of distribution hopper 43 reaches a predetermined set level, load cells 44 cause the closing of contacts 102, which results in the actuation of solenoid 104 on line 103, closing receiving hopper material holding gate 65. After gate 65 is closed, contact 105 on line 106 is closed. Motor 107 of actuating means 35' then closes gas sealing valve 53. Material then ceases to enter distribution hopper 43, and receiving hopper 60 which was previously empty begins to fill with material from conveyor 67. After valve 53 is closed, contact 112 on line 130 closes, which actuates motor 87 to raise stock rods 75 and 76, and at the same time, contact 112 on line 113 closes, which actuates solenoid 115 to open the distribution hopper purge equalization valve 72. When the pressure in distribution hopper 43 reaches that in the furnace, contact 119 on line 122 opens. Motors 124 of actuating means 35 open distribution hopper gas sealing valves 30, closing contacts 125 on line 133, and solenoids 134 of actuating means 56 open distribution hopper material holding gates 55. Material is then discharged from distribution hopper 43 downwardly into distributor member 10 (FIG. 13). After gates 55 are opened, contact 182 on line 150 closes, causing solenoid 152 of actuating means **20*b* to raise distributor member 11** through the flow of material to produce the desired even material distribution in the furnace.

After distribution hopper 43 has been fully emptied, load cells 44 sense the zero weight of material in hopper 43 and cause the closing of contacts 137. Contact 137 on line 160 closes, and solenoid 161 of actuating means **20*b* returns distributor member 11 to its lowermost position. Contact 137 on line 164 also closes so that motor 87 lowers stock rods 75 and 76. The stockline level is measured, and the information is sent from indicating means 98 to logic unit 100. Closed contacts 137 on lines 138 actuate solenoids 139 of actuating means 56, closing distribution hopper material gates 55. After gates 55 are closed, contacts 140 on lines 141 are closed. Motors 142 of actuating means 35 close distribution hopper gas sealing valves 30**.

With contacts 114 on line 166 closed, solenoid 167 is actuated, opening distribution hopper relief valve 72. When the pressure in distribution hopper 43 has been relieved to atmospheric level, contact 172 on line 173 closes, and motor 174 of actuating means 35' opens receiving hopper gas sealing valve 53.

Material continues to fill receiving hopper 60 from conveyor 67 until hopper 60 is filled, at which time load cells 61 cause contact 178 on line 177 to close, and solenoid 179 opens receiving hopper material holding gate 65. Material is discharged from receiving hopper 60 downwardly into distribution hopper 43 (FIG. 8). When distribution hopper 43 is filled, the sequence of operations as just described begins again.

The circuitry of FIG. 12 also contains switches 121 and 151 and logic-controlled contacts 128, 153 and 162 to permit the apparatus to adjust charging operations under the control of logic unit 100 if, for example, an unevenness occurs in the body of charge material in furnace chamber 5.

It is also possible to adapt the control circuitry and logic unit to correct an unsymmetrical, uneven stockline condition in which one quadrant has a lower level than the other quadrant. If this occurs, special logic programs in logic unit 100 may be used to recognize the location of the unevenness in the stockline, and cause the logic unit to effect a coordinated use of the proper material holding gate 55, gas sealing valve 30 and stock rod 75 and of the proper movement of the distributor member 11 to rectify the abnormal condition by delivery material only to that appropriate area in the furnace, as indicated in FIG. 14. Logic unit 100 would initiate this procedure by changing the position of switches 121 from their "normal" position to their "off normal" position. At the same time, contacts 128 would be closed only for the material holding gates 55 and gas sealing valves 30 which are desired to be opened to produce a more even stockline. The remaining gates and valves would be left closed. As a result, material would be delivered through the gates and valves only to the portion of the stockline which is abnormally low, and the stockline is evened thereby.

The method of operation using the circuitry of FIG. 7 may also be modified to permit material holding gates 55 and gas sealing valves 30 to be closed after material has been discharged into bell hopper 6 and before bell 8 has been opened to discharge material into furnace chamber 5, so that material holding gate 65 and gas sealing valve 53 may be opened and distribution hopper 43 may be filled with material from receiving hopper 60 while the next charge is being temporarily stored in bell hopper 6, as illustrated in FIGS. 15, 16 and 17. As with the first described method, material is discharged from distribution hopper 43 into bell hopper 6 (FIG. 9), and thereafter material holding gates 55 and gas sealing valves 30 are closed. While the charging material is being temporarily stored in bell hopper 6, material holding gate 65 and gas sealing valve 53 are opened to permit material in receiving hopper 60 to be continuously introduced into distribution hopper 43 (FIG. 15). After stock rods 75 and 76 indicate a low stockline level, bell 8 is opened and the material in hopper 6 is emptied onto upwardly moving distributor member 11 (FIG. 16). Gate 65 and valve 53 are thereafter closed when distribution hopper 43 is full (FIG. 17). When bell hopper 6 has been emptied and bell 8 is closed, gates 55 and valves 30 may be opened to dump the next charge into the hopper 6. This method of operation is useful since it permits a more rapid charging procedure than possible with the previously described methods.

Various modifications may be made in the methods of operation and control apparatus as described above.

Thus, solenoids 152 and 161 may be exchanged so that the distributor member 11 is moved from an upper position within chamber 5 to a lower position below opening 15 in outer member 10 during discharge of the material instead of a reverse direction as described above.

The above described apparatus and methods of operation provide unique and important advantages in distributing the charge material in the furnace to provide a stockline of desired contour, and also in distributing the charge material so that there is a highly uniform distribution or mixture of smaller and larger particles. The advantages are achieved in the illustrated apparatus despite the lack of any rotating mechanical components for distributing charge material, such as rotating hoppers or chutes. Omission of such rotating components provides additional advantages by eliminating problems that could otherwise arise in the sealing of the rotating components against gas leakage, and in the maintenance work on such components either inside or outside of the furnace, as well as by eliminating substantial costs that would arise from the more complicated construction and maintenance of apparatus with rotating components.

The segregation and mixing of the smaller and larger particles in the charging apparatus is illustrated in schematic form in FIG. 18. As already described, port means 49 including conduit portion 50 provide a choked feed of material into hopper 43 in which the smaller or fine particles tend to segregate toward the axial center of the conduit and the larger or coarse particles tend to segregate in the radial outer periphery. When the nonuniform distributed material discharges from conduit 50, it strikes the coaxial, generally conical dividing portion 48 which provides substantially equal particle size distributions to each of the legs 45 so that each leg contains substantially the same amount of fine particles. However, the fine particles F still tend to segregate toward the inside of each leg 45 while the larger particles L tend to segregate toward the outside. As the material is discharged through port means 26 into bell hopper 6, a less pronounced segregation of particles occurs with a symmetric vertical annular layer of fine particles F′ surrounded on each side of annular layers of larger particles L′.

As the material is discharged from bell hopper 6 into charge distributor means 9, the fine and coarse particles are intermixed and evenly distributed into the furnace 1. The even stockline results from the movement of distributor member 11 from the lower position shown in solid lines in FIG. 18 producing a particle discharge D, to an intermediate position designated 11′ producing a particle discharge D′, to an upper position shown in broken lines and designated 11″ producing a particle discharge D″. The speed with which the distributor member 11 moves upwardly is regulated so that the discharges D, D′ and D″ are essentially equal, producing an equal distribution of particles in the furnace 1.

The uniformity of intermixing of small and large particles results from the numerous charges in directions of inclinations or surfaces contacted by the charge material as it passes into and from hoppers 43 and 6, and as it strikes the inclined surfaces of hopper 6, bell 8, distributor member 10, and the moving distributor member 11. Such repeated contacts with surfaces of different opposite inclinations causes the material to change direction a plurality of times as it moves downwardly overcoming any segregating effects arising from the tendency of fine particles to segregate from large particles as a mass of large and small particles moves down an inclined surface, since the different inclinations of the apparatus illustrated cause the small particles to become intermixed with the large particles on repeated changes of direction of the material. Consequently, when the charge material finally is deposited in the furnace, it is a mass of thoroughly intermixed large and small particles in which the differently sized particles are distributed with a high degree of uniformity.

The mechanical activity of the different sizes also has an effect on the distribution. The course and medium size particles have a rolling action combined with their sliding down the inclined surfaces of the bell hopper 6, spreader bell 8, and the distributor members 9 and 10, while the action of the fine material is confined primarily to sliding. Some of the larger size particles continue to roll after reaching the furnace whereas the smallest size pieces remain where they drop from the distributor means 9. The result of this activity is to scatter the coarse and medium size materials over a larger area in the furnace chamber 5 than the fine material. In the method and apparatus of this invention, these effects are largely compensated for by changing the position of spreader bell 8 relative to bell hopper 6 during the dump and changing the timing of the movement of the movable distributor member 11.

To demonstrate the uniform distribution of particle sizes achieved by the method and apparatus of the present invention, tests were conducted using a test model charging apparatus shown in FIGS. 19–22. Test model apparatus 201 was approximately a one-fifth scale model of charging apparatus suitable for an oil shale retort such as that depicted in FIG. 1. Apparatus 201, which was constructed on test tower 202, had all of the principal features of the invention including internal stationary bell hopper 6 having bottom opening 7 to be closed and opened by movable spreader bell 8, and charge distributor means 9 comprising stationary outer distributor member 10 and movable inner distributor member 11. Bell 8 was supported and moved by tubular rod 18, and distributor member 11 was supported and moved by rod 19 extending through rod 18. Actuating means 20 raised and lowered bell 18 and member 11 as required. Hopper 6 received particulate material through four port means 26. A temporary storage or distribution hopper 43 was mounted immediately above the port means 26. Hopper 43 had a plurality of downwardly extending conical legs 45 equal in number to the port means 26 and each adapted to discharge into one of the port means. The legs 45 met at the bottom of hopper 43 to form a generally conical dividing portion. The lower portion of each leg 45 of hopper 43 had fixed to it a cylindrical portion internally supporting a material holding gate 55. In place of the closure members of the embodiment already described, the test apparatus used four slide gate valves each actuated by pneumatic cylinders 56.

Instead of belt conveyor 67 and receiving hopper 60, the test model apparatus utilized a charging means comprising two drop-bottom charging buckets 203 supported by hoists 204 on a monorail 205. The material was transferred from buckets 203 to distribution hopper 43 by charging chutes 207. Both buckets 203 were emptied through charging chutes 207 simultaneously to deposit a symmetrical load in hopper 43.

In place of the furnace or retort 1, the material was distributed into a sampling receptacle 209 which simulated a blast furnace stockline or an oil—shale—retort. Sampling receptacle 209 was mounted on wheels 211 and rails 212 so that it could be removed from the testing position to a different portion 213 for measurements (FIG. 19). Sampling receptacle 209 was provided with seventeen sampling cylinders 214 (FIGS. 23 and 24) spaced radially and circumferentially around receptacle 209 in corresponding openings in a horizontal platform 215 spaced above the bottom 216 of the receptacle. As shown in FIG. 23, these cylinders were assigned numbers from 1 through 17. Each cylinder 214 had a vertically movable pedestal 217 mounted to a support rod 218 supported on the bottom 216 of the receptacle. During the distribution test, cylinder pedestal 217 was raised to the top of the cylinder, providing a continuous surface level with platform 215 for the bed of test material. After the test is completed, sampling receptacle 209 was removed from the test position, and the surface of the distributed test material was measured for uniformity by removal of cylinders 214. Cylinders 214 were removed from the openings in platform 215 by means of a handle 220 attached to the upper portion of each cylinder. As cylinders 214 were lifted to cut a precise sample from the test bed at each sample cylinder location, the movable pedestal 217 lowered to collect the test sample in the cylinder (FIG. 25).

The test material comprised oil shale particulate material. A sieve analysis was performed on the test material prior to testing to establish a standard composition sample. This analysis produced the following breakdown:

| | Maximum Size | Minimum Size | Percent of Total Weight |
|---|---|---|---|
| Coarse | 1.5 in. | 0.75 in. | 57.8% |
| Medium | 0.75 in. | 0.25 in. | 28.7% |
| Fine | 0.25 in. | 0 | 13.5% |

The actual size composition of the material for each dump varied from the initial measurements given above. The size composition of the charged material for the dump is not the same as the size composition of the resulting dumped material, since the dumping process tends to break up larger particles. There is less coarse material and more medium and fine material in the dumped material than in the charged material.

In the test dump procedure, two charging buckets 203 were used each having a predetermined amount of the standard sample composition test material as required for each test. Both charging buckets 203 were raised to the top of the test tower 202 and positioned over the two diametrically opposed charging chutes 207. Both buckets 203 were dumped simultaneously, loading hopper 43 on top of the test model apparatus. The four air operated actuating cylinders 56 were then opened simultaneously, loading the total test charge into bell hopper 6. The operational sequence was initiated, and the material distributed into the removable sampling pot 209 located at the lower level of test tower 202. Sampling receptacle 209 was then moved along rails 212 from beneath the test model apparatus to the measurement position 213, and sampling cylinders 214 were removed and analyzed.

A sieve analysis was made of the core sample from each of the seventeen cylinders and the percent by weight of each size was recorded. The sieve analysis of each sample cylinder was then compared with the standard composition sample.

A statistical analysis of the dump test was made to compare the distributions achieved in various areas of the test bed. Five typical dumps were used for data analysis, providing a statistically significant number of samples. The areas of the test bed were compared by selecting a group of the samples in a given semi-circle or a group of the samples making up a ring as shown in FIG. 26. The mean size compositions of each sample group are compared to the mean of all the samples in all five test dumps. Differences between the five dump average and the sample group average were expressed as percent deviation, given in FIG. 26 in the second column to the right of the mean for each size.

The mean percent weight was calculated according to $$\bar{x} = \sum_{i=1}^{n} \frac{x_i}{n}$$

For the five dump average, the samples $x_i$ were the percent by weight of the course, medium or fine particles at all 17 sampling points for all five dumps, so that the number of samples was $$n_{dump} = 17 \times 5 = 85$$

For each group, the samples $x_i$ were the percent by weight of the size of particles in the eight sampling points in that group for all five dumps, so that the number of samples was $$n_{group} = 8 \times 5 = 40$$

The standard deviation was calculated according to:

$$s = \sqrt{\frac{\Sigma(x_i^2) - n(\Sigma x_i)^2}{n-1}}$$

Finally, deviation of the mean of each group from the mean of all five dumps was compared using a percent deviation calculated according to:

$$\frac{\bar{x}_{dump} - \bar{x}_{group}}{\bar{x}_{dump}} \times 100\%$$

The results of this analysis are shown in FIG. 26. At the top of the chart of FIG. 26, $\bar{x}_{dump}$ and $s_{dump}$ are given for each of the three sizes of particles. Below these values are given $\bar{x}_{group}$ and $s_{group}$ for ten groups consisting of eight semi-circular areas and two annular areas.

Further analysis of the data was made to determine a measure of reliability that the distribution pattern will be repeatable and that the precent deviations calculated for the five dump averages will be typical of all multiple dump situations. This analysis assumed a Student's t distribution in which t was calculated according to Student's ratio, wherein:

$$t = \left(\frac{\bar{x}_{group} - \bar{x}_{dump}}{s_{group}}\right) \sqrt{r}$$

where $r = n_{group} - 1$ is the number of degrees of freedom. From this calculated value for t, the probability distribution function A can be determined for r degrees of freedom from standard statistical tables. The percent probability P is then calculated as follows:

$$P = \tfrac{1}{2}(1 - A) \times 100\%$$

The one-half factor is included in this calculation since the t distribution is symmetrical about zero, and the area A under the curve should be measured from t=0 to the calculated value of t rather than from $t = -\infty$ as is given in most tables.

Previous experience with columnar counterflow beds has indicated that deviation in fines distribution of as much as 12 percent do not seriously affect the overall permeability of the column. Distribution deviations of 15 percent or less are considered to be excellent for large scale production processes. The tests made with the test model charging apparatus all fell within this range. The largest deviations found were in the fine material in the two circle groups in which the deviations averaged about 11 percent. After the tests were completed, it was later discovered that the largest deviations were related in part to a minor mechanical problem which could be readily corrected, the problem being a small gap between bell 8 and the bell hopper above the location of sample point 11 resulting in a concentration of fines in one particular location.

The maximum deviation found for a semi-circle segment test was 6.3 percent for the fine material in the southwest half; the probability of this figure being exceeded is about 12 percent of the dumps. The maximum deviations for the medium and coarse distributions were about one-third that of the fines, and the probability of these maximum deviations being exceeded is 4.5 percent for the coarse and 1.2 percent for the medium.

Bed level measurements were also conducted to determine the degree of repeatability in producing a level bed of distributed material and to determine the methods of operation for correcting a non-level stockline. Charges of standard sample composition test material were run through the apparatus as previously described. Upon completion of each dump cycle sampling receptacle 209 was removed from the apparatus and a straight edge 222 (FIG. 24) was placed across the top of the receptacle. Measurements were then taken from this reference edge 222 to the top of the material surface S at the numbered sample points shown in FIG. 25. The degree of repeatability and producing a level layered stockline is shown by comparing the measurements at similar sample points from test to test for similar dump and delay times. The test results are shown in the following tables:

| Test No. | 1 | 2 | 3 | 4 | 5 | 6 |
|---|---|---|---|---|---|---|
| Total Dump Time (Sec.) | 22 | 23 | 23 | 22.5 | 24 | 21.5 |
| Delay Time (Sec.) | 5 | 8 | 8 | 8 | 8 | 8 |
| | Bed Level Measurements (inches from top) | | | | | |
| Sample Point | NORTH | | | | | |
| 5 | 30.50 | 28.50 | 28.50 | 27.00 | 27.50 | 27.50 |
| 4 | 26.25 | 29.00 | 28.75 | 28.50 | 28.50 | 28.50 |
| 3 | 21.75 | 29.75 | 24.75 | 26.50 | 28.50 | 28.50 |
| 2 | 28.00 | 28.00 | 28.00 | 28.00 | 27.25 | 27.50 |
| 1 | 30.25 | 28.00 | 28.25 | 28.50 | 28.75 | 27.50 |
| | SOUTH | | | | | |
| | West | | | | | |
| 15 | 29.50 | 28.00 | 28.00 | 28.00 | 28.00 | 26.50 |
| 14 | 27.50 | 29.00 | 28.00 | 27.25 | 27.00 | 28.50 |
| 3 | 21.75 | 29.75 | 25.75 | 26.50 | 28.50 | 28.50 |
| 8 | 26.50 | 28.75 | 28.25 | 28.75 | 29.25 | 28.50 |
| 9 | 29.50 | 29.00 | 28.00 | 28.00 | 27.00 | 28.00 |
| | EAST | | | | | |

| Test No. | 7 | 8 | 9 | 10 | 11 |
|---|---|---|---|---|---|
| Total Dump Time (Sec.) | 21 | 20.5 | 21.75 | 20.5 | 20.0 |
| Delay Time (Sec.) | 8 | 7 | 7.5 | 8.0 | 7.5 |

Bed Level Measurement

-continued

| Sample Point | (inches from top) | | | | |
|---|---|---|---|---|---|
| | NORTH | | | | |
| 5 | 27.50 | 29.00 | 27.50 | 27.00 | 28.00 |
| 4 | 28.50 | 27.50 | 28.00 | 27.00 | 28.50 |
| 3 | 31.00 | 25.50 | 29.00 | 31.00 | 29.75 |
| 2 | 29.00 | 27.25 | 26.25 | 26.25 | 27.50 |
| 1 | 28.50 | 29.50 | 27.50 | 27.50 | 27.75 |
| | SOUTH | | | | |
| | West | | | | |
| 15 | 27.00 | 29.50 | 28.00 | 26.50 | 27.00 |
| 14 | 29.00 | 27.00 | 25.50 | 26.50 | 27.75 |
| 3 | 31.00 | 25.50 | 29.00 | 31.00 | 29.75 |
| 8 | 30.00 | 26.00 | 26.00 | 25.50 | 27.50 |
| 9 | 27.00 | 27.75 | 28.00 | 27.00 | 27.50 |
| | EAST | | | | |

The test results demonstrated the capability of the test model charging apparatus to maintain the stockline level to within very small deviations.

It was also demonstrated that a non-level bed distribution in the sampling receptacle could be corrected by keeping distributor member 11 inoperative when in its lower position, upper position and mid-position. With distributor member 11 inoperative and positioned in its lower position, a ring of material was distributed around the outer edge of sampling pot receptacle 209 with no material deposited in the center. With distributor member 11 inoperative and positioned in its upper position the material was deposited in the center of sampling receptacle 209 with no material distributed to the outer edges. With distributor member 11 inoperative and positioned in its midstroke position a ring of material was deposited in a circle at the mean diameter of the sampling receptacle, with no material being distributed to either the outer edge or to the center of the sampling receptacle.

When operating two of the four material holding gates, a level bed of material across the entire distributor sampling receptacle was produced. Since only a portion of the full charge was dumped, the bed depth was proportioned to the depth when dumping a full charge.

It was thus demonstrated that by the proper operation of the test model charging apparatus, corrective action can be taken to maintain a level stockline or correct a non-level stockline. Whereas, the values described above are the results of tests conducted with oil shale, similar results can be expected with all blast furnace materials.

In the embodiment described above and illustrated in FIGS. 1–18, spreader bell 8, outer distributor member 10, and inner distributor member 11 should be properly dimensioned with respect to each other and with respect to the retort or furnace being charged in order to achieve the desired distribution. The following table sets forth the relationship between the dimensions shown in FIG. 27, and gives the range of design values and the desired value for each dimension ratio or angle:

| Dimension Ratio or Angle | Minimum Value | Maximum Value | Preferred Value |
|---|---|---|---|
| $\frac{L_1}{L_2}$ | 6.38 | 9.58 | 7.98 |

-continued

| Dimension Ratio or Angle | Minimum Value | Maximum Value | Preferred Value |
|---|---|---|---|
| $\frac{D_2}{D_1}$ | 1.37 | 2.06 | 1.71 |
| $\frac{D_3}{D_1}$ | 1.02 | 1.09 | 1.05 |
| $\frac{H}{D_3}$ | 0.57 | 0.86 | 0.71 |
| $\frac{D_2}{D_3}$ | 1.27 | 1.90 | 1.59 |
| X | 45° | 65° | 53° |
| Y | 40° | 60° | 45° |
| Z | 45° | 65° | 60° |

While the upper surface of distributor member 11 has been shown as curved, it may be of conical, frustoconical or other suitable inwardly convergent shape. While the shape of the surface of outer distributor member 10 has been shown as frustoconical, it may be suitably curved.

Various changes may be made in the apparatus illustrated other than those indicated. For example, while four port means 26 and four legs 45 of distribution hopper 43 are disclosed the greater or lesser number of port means and legs may be used, although four port means appear to be adequate for most situations.

Different means to sense and signal the level of the stockline may be utilized, such as gas sensing means.

Similar beneficial results can also be provided if movable distributor member 11 is held stationary in various positions in its upright path as charge material is discharged downwardly into distributor means 9 comprising members 10 and 11.

A gas lock means may be provided in bell hopper 6 in place of or in addition to the gas lock provided in distribution hopper 43 between gas sealing valves 30 and gas sealing valve 53. Spreader bell 8 may make a sealing engagement with opening 7 in bell hopper 6 to provide a gas lock between the bell and gas sealing valves 30 which may operate similar to the gas lock in distribution hopper 43 already described. Bell hopper 6 may have conduits similar to conduits 69 and 71 and valves similar to valves 70 and 72, to permit gas equalization and relief in the bell hopper.

Where as the use of the spreader bell 8 is desirable to provide a desired spreading distribution of the charge material under some circumstances such a bell may be omitted as shown in FIG. 28. The mode of operation can otherwise be similar to those described above.

If desired, a distribution effect similar to that of a rotating component such as a chute can be achieved in the illustrated apparatus by appropriate sequencing of gas sealing valves 30 and their associated material holding gates 55, either by manual presetting or on a programmed basis as sensed by the stock rods.

While in the illustrated apparatus the conveyor continuously discharges material into the receiving hopper 60 which in turn automatically discharges into the distribution hopper 43, other means of depositing material into the distribution hopper may be used. For example, charge material may be intermittently deposited into the distribution hopper as by a skip car or intermittently moving conveyor.

However, the apparatus illustrated makes possible the simultaneous operation of a plurality of shaft furnaces, such as retorts, to all of which charge material is continuously supplied as by continuously moving belts or by chutes, thus making possible the use of several shaft furnaces supplied from a common source of charge material. This is desirable in some circumstances such as oil shale retorting.

While the apparatus shown in FIGS. 1 to 18 has been described with respect to an oil shale retort and is particularly adapted for charging homogeneous material of any kind into a retort or shaft furnace, the apparatus and method of this invention may also be adapted for use in charging batches of different material into a furnace such as a shaft furnace as shown in FIG. 29. The illustrated blast furnace 301 of otherwise known construction has a furnace chamber 305 in which is disposed a body of charging material. Typically, four offtakes 305*a* communicate with furnace chamber 305. The apparatus includes an internal stationary bell hopper 306 having a bottom opening 307 adapted to be closed and opened by a vertically movable spreader bell 308. Charge distributor means 309 is located in the upper portion of the furnace below the hopper 306 and bell 308, and comprises a stationary outer distributor member 310 and a movable inner distributor member 311. Member 311 is mounted for movement in an upright path extending between a lowermost position shown in full lines, and uppermost position designated 311' and an intermediate position designated 311".

Bell 308 is supported, lifted and lowered by a tubular rod 318, and distributor member 311 is supported, lifted and lowered by rod 319 extending axially through rod 318. Known means 320 are provided for actuating the rods to raise and lower bell 308 and member 311 as required.

Conduits 324 and 325 open into the upper portion of the furnace above the stockline to permit the removal of vapors and gases produced as a result of the blast furnace operation.

The top of the furnace has a plurality of port means 326, four port means in the illustrated embodiment, each comprising a housing portion 327 having an upper conduit portion 328. Each housing portion 327 includes a gas sealing valve 330 adapted to close and open the lower end of conduit 328 of each port means 326. The gas sealing valve 330 is generally like valve 30 already described.

A temporary storage or distribution hopper 343 is fixedly mounted immediately above the port means 326. Hopper 343 has a plurality of downwardly extending legs 345 equal in number to the port means 326, each adapted to discharge into one of the port means. At its lower portion, each leg opens through an upwardly widening transition portion 346 into an upper hopper portion 347, the transition portion having a generally conical dividing wall portion 348. An entrance port means 349 has a conduit portion 350, providing a choked feed, so that dividing portion 348 functions similarly to dividing portion 48 in dividing and distributing substantially equal amounts of material to each of the legs 345.

Port means 349 is similar to port means 49, comprising a housing portion 351 and gas sealing valve 353, generally similar to valve 53.

The lower portion of each leg 345 of hopper 343 has a material holding gate 355 generally similar to material holding gates 55 but, as shown, comprising a single closure member 355*a*.

A receiving hopper 360 is fixedly supported above hopper 343. Hopper 360 has a discharge portion 364 containing a material holding gate 365 generally similar to gates 355. A belt conveyor 367 is provided to discharge particulate material into hopper 360, the conveyor being enclosed in a suitable housing 368. Unlike receiving hopper 60, hopper 360 is not intended to store a substantial amount of material. It is contemplated that in blast furnace operation, belt conveyor 367 will not be continuously feeding material to hopper 360, but that premeasured batches of the various types of blast furnace charging material, such as sinter, pellets, or coke, will be fed as needed to distribution hopper 343 from a stockhouse of the other end of conveyor 367. At other times, conveyor 367 will be operating without charge material being fed onto conveyor 367 at the stockhouse, and material holding gate 365 would be closed to prevent material from entering hopper 343. A small amount of residual material from conveyor 367 will enter hopper 360, but will be prevented from falling onto gas sealing valve 353 by material holding gate 365.

Alternatively, belt conveyor 367 may be operated continuously with the apparatus employing a method of operation similar to that shown in FIGS. 15, 16 and 17 in which material holding gate 365 and gas sealing valve 353 are closed only while distribution hopper 343 is being emptied.

Distribution hopper 343 also has a conduit 369 controlled by a valve 370 to permit discharge of gas from the interior of hopper 343 to relieve the pressure in the hopper to that of atmosphere before gas sealing valve 353 and gates 365 are opened to permit charge material to drop into hopper 343 while gates 355 and gas sealing valves 330 are closed. Hopper 343 also has another conduit 371 controlled by a valve 372 to permit suitable gas to be introduced into the interior of hopper 343 to raise its internal pressure so that of the gas pressure in the furnace after the gate 365 and gas sealing valve 353 have been closed and before any of the lower gas sealing valves 330 and gates 355 have been opened to permit discharge of material from hopper 353 into the hopper portion 306 of the furnace 301.

The valve containing portions of hoppers 343 and 360 and port means 326 in combination with hopper 343 itself provide gas lock means permitting charge material to be introduced from receiving hopper 360 into distribution hopper 343 and from hopper 343 into hopper 306 in the furnace without undesired loss of gas pressure from within the furnace, similarly to the similar valve portions of the retort apparatus already described.

The furnace apparatus of FIG. 29 also includes stockline sensing means including outer stockline level sensing devices 375 and central stockline sensing device 376 connected to actuating and sensing means, which devices are similar to the stock rods 75 and 76 and connected similar apparatus already described.

As shown in the illustrated embodiment, hoppers 343 and 360 are fixedly mounted, and do not include load cells such as cells 44 and 61 of the retort charging apparatus. In blast furnace charging operation, the amount of material in the hoppers is controlled by the stockhouse measurement of the amount of each batch of material supplied by conveyor 367, so that the load cells and other way means are not necessary for this embodiment. It is to be understood, however, that similar load cells and weigh means may be included in a blast furnace charging apparatus similar to that shown and be operated in a manner similar to the retort charging apparatus already described.

The blast furnace charging apparatus of FIG. 29 may employ control circuitry such as that shown in FIG. 30. The circuitry of FIG. 30 is essentially the same as that of FIG. 7 except that contacts 102, 137 and 178 have been eliminated since there are no load cells for weighing the material in the hoppers. In place of contacts 102, 137 and 178, top sequence logic controlled contacts 401, 402 and 403 are used. Contacts 401, 402 and 403 are controlled by programmed intelligence contained in logic unit 100 which governs the charging sequence in the same manner as with the load cell signals. The control of contacts 401, 402 and 403 is accomplished by means of incomplete sequence monitoring by the logic unit and by timing calibration set in accordance with the time required for material to fill or empty the hoppers based upon the estimated flow rate of charge material into or out of the hopper.

The methods of operation of the blast furnace charging apparatus of FIG. 29 would be generally like those of the retort charging apparatus already described.

Modifications other than those discussed above may also be made.

The present invention thus provides an apparatus for charging material into a shaft furnace such as a vertical oil shale retort or blast furnace, that makes possible distribution of the material in the furnace to achieve a stockline of any desired shape within wide limits, preferably a highly level stockline, and to achieve a body of charge material in the furnace in which large and small particles are highly uniformly intermixed and distributed, without the use of any rotating mechanical components for distribution the charge material and by use of only a very few moving parts which are simple and rugged in construction so they do not deteriorate even over long service and so that they require little maintenance. Such desired distribution can be achieved even in furnaces of large cross-sectional size that require high rates of charging of material into the furnace and have a large diameter over which the charge material must be properly distributed. Moreover, the apparatus of the invention makes possible operation at furnace top pressures as high as any now used or in the foreseeable future.

The means provided by the present invention makes possible the deposition of charge material in the furnace with a high uniformity of distribution of particle sizes, and with a high uniformity of stockline level and thus makes possible desired highly uniform gas permeability in the furnace to achieve stable furnace operation, efficient utilization of gas and fuel, and efficient recovery of vapors and gases containing oil and other valuable constituents.

Other advantages of the invention will be apparent to those skilled in the art.

Various modifications apparent to those skilled in the art in addition to those indicated above may be made in the apparatus and processes disclosed above, and changes may be made with respect to the features disclosed, provided that the elements set forth in any of the following claims or the equivalents of such be employed.

What is claimed is:

1. Apparatus for charging particulate charge material into a receptacle having an upper portion including a top and upright side wall means defining a chamber into which charge material is to be deposited to form a stockline, said apparatus comprising choked feed means above said receptacle adapted to discharge charge material downwardly in a single downwardly flowing stream of compact cross section along a single path;

nonrotatable and laterally immovable dividing means below said choked feed means in said path of said stream and above said receptacle adapted to have said downwardly flowing single stream of charge material substantially directly impinge downwardly on said driving means and uniformly divide said downwardly flowing single stream of charge material into a plurality of separate streams of charge material;

gas lock means at the upper portion of said receptacle permitting the entrance of charge material into said receptacle without harmful loss of gas from within said receptacle;

means for causing said plurality of separate streams from said dividing means to pass through said gas lock means into said receptacle; and said receptacle having distributor means located therein for distributing within said receptable material delivered thereto, spreader means above said distributor means for laterally spreading charge material to said distributor means from said gas lock means, and said distributor means and said spreader means being operable substantially independently of said gas lock means.

2. The apparatus of claim 1 wherein said spreader means includes hopper means adapted to receive charge material entering said receptacle, said hopper means having a downwardly inwardly converging inner wall of generally circular cross section coaxially therewith and terminating in a lower opening of generally circular cross section into which hopper means charge material entering said receptacle is deposited, and a bell having a downwardly outwardly diverging outer surface of generally circular cross section and terminating in a maximum perimeter portion of generally circular cross section, which maximum perimeter portion has a diameter substantially larger than that of said opening, said bell being adapted to be raised to close said opening to retain charge material in said hopper means and to be lowered to open said opening and permit charge material in said hopper means to pass over said bell surface and discharge into said distributor means.

3. The apparatus of claim 1 in which said dividing means and said receptacle are adapted to cause charge material to be discharged downwardly by gravity from said dividing means in a plurality of streams into said receptacle through a plurality of laterally spaced port means.

4. The apparatus of claim 2 in which said dividing means comprises a generally conical member positioned within hopper means positioned above said receptacle.

5. The apparatus of claim 1 wherein said divider means is included in a first hopper means located above and outside of said receptacle, said first hopper means being adapted to deposit charge material from said choked feed means directly onto said dividing means and to discharge charge material into said receptacle from said driving means.

6. The apparatus of claim 5 comprising means adapted to sense the height of the stockline of charge material in said receptacle; and means operatively associated with said stockline sensing means for causing said means for discharging charge material from said first hopper means to discharge charge material from said first hopper means into said receptacle when said stockline sensing means senses that the stockline has moved in said receptacle below a predetermined height.

7. The apparatus of claim 6 comprising second hopper means adapted to receive charge material from said first mentioned hopper means and to discharge charge material into said receptacle when said stockline sensing means senses that the stockline has moved below said predetermined height.

8. The apparatus of claim 6 comprising material holding means between said first hopper means and said receptacle adapted to be opened to discharge charge material from said first hopper means into said receptacle and to be closed to retain charge material in said first hopper means; and means for opening said material holding means to permit charge material to pass from said first hopper means into said receptacle when said stockline sensing means indicates that said stockline has moved below a predetermined height.

9. The apparatus of claim 8 wherein said gas lock means includes gas sealing means located between said first hopper means and said receptacle and below said material holding means; and means for opening said gas sealing means before said material holding means when said stockline sensing means senses that said stockline has moved below a predetermined height.

10. The apparatus according to claim 5, 6, 7 or 8 wherein said first hopper means includes first port means through which charge material is received, second port means through which charge material is discharged, said gas lock means including first gas sealing means for said first port means and second gas sealing means for said second port means.

11. The apparatus of claim 10 comprising a receiving hopper means located above said first hopper means and adapted to receive charge material from a source, temporarily store charge material, and discharge charge material into said first hopper means.

12. The apparatus of claim 11 including means for causing charge material to discharge from said receiving hopper means into said first hopper means when said first hopper means is empty of charge material to a predetermined degree.

13. The apparatus of claim 12 comprising means for weighing charge material while it is in said hopper means and for halting said means for introducing charge material into said hopper means after a predetermined weight of charge material has been introduced into said hopper means.

14. Apparatus for charging particulate charge material of varying sizes into a receptacle having an upper portion including a top and upright side walls defining a chamber into which charge material is to be deposited to form a stockline, said apparatus comprising: a source of charge material; receiving hopper means outside of and above said receptacle adapted to receive charge material from said source, temporarily store charge material, and discharge charge material downwardly; first port means at the lower portion of said receiving hopper means through which charge material is discharged from said receiving hopper means; choked feed means in said first port means adapted to discharge material downwardly in a stream of compact cross section; first gas sealing means at said first port means adapted to be opened and closed; nonrotatable and laterally immovable distribution hopper means above said receptable and below said receiving hopper means adapted to receive charge material from said receiving hopper means through said first port means; nonrotatable and laterally immovable generally conical dividing means within said distribution hopper means directly below said choked feed means adapted to have charge material discharged downwardly from said choked feed means directly impinge downwardly on said dividing means to uniformly divide said stream of compact cross section falling upon it from said choked feed means into a plurality of separate streams of charge material; a plurality of laterally spaced lower second port means between said distributor hopper means and said receptacle through which charge material is discharged from said distribution hopper means, each of said plurality of separate streams passing through one of said plurality of lower second port means; material holding means in each of said lower second port means adapted to be opened to discharge charge material downwardly from said distribution hopper means and to be closed to retain charge material in said distribution hopper means; second gas sealing means in each of said lower second port means adapted to be opened to permit charge material to pass from said distribution hopper means and to be closed to retain gas pressure within said receptacle, said first and second gas sealing means forming a gas lock means permitting the entrance of charge material into said receptacle without harmful loss of gas from said receptacle; spreader means below said upper port means, acting to laterally spread charge material in said separate streams, said spreader means comprising a bell having an upwardly convergent top surface, a bell hopper means adapted to receive charge material from said distribution hopper means through said lower port means, said bell hopper means having a bottom opening adapted to be closed by said bell, and means for causing relative movement between said bell and said bell hopper means to discharge charge material from said bell hopper means and to close said bottom opening to retain charge material in said bell hopper means; distributor means within the upper portion of said receptacle below said spreader means, said distributor means comprising an outer distributor member having a downwardly converging inner wall terminating in a lower opening into which charge material is deposited from said spreader means, an inner distributor member having a downwardly diverging outer surface terminating in a maximum perimeter portion of a cross section smaller than but approaching the cross section of said opening in said outer distributor member, and means for causing relative movement between said distributor members in an upright path between an initial position in which said maximum perimeter portion of said inner distributor member is located below said opening in said outer distributor member and a final position in which said maximum perimeter portion is located above the opening in said outer distributor member while charge material is being discharged from said spreader means into said outer distributor member, to cause charge material to be deflected toward the side wall means of said receptacle when said maximum perimeter portion of said inner distributor member is below said opening and toward the central portion of said chamber when said maximum perimeter portion of said inner member is above said opening; said spreader means and said distributing means providing a plurality of surfaces of different inclinations to cause charge material to change angular directions from the vertical at least twice as it moves downwardly before it is deposited in said receptacle to uniformly mix the particles of charge material; stockline sensing means for sensing the height of the stockline at a plurality of locations outwardly from the center of the stockline and at a location generally centrally of the stockline in said receptacle; first control means operatively associated with said stockline sensing means for opening said second gas sealing means and said material holding means and for opening said bell to discharge charge material into said receptacle when said stockline sensing means senses that said stockline has moved below a predetermined height, said first control means operating to open said second gas sealing means only when said first gas sealing means is closed; second control means for opening said first gas sealing means to permit charge material to be introduced into said distribution hopper means when said distribution hopper means is empty to a predetermined degree and when said second gas sealing means is closed.

15. The apparatus of claim 14 in which said means for causing relative movement between said bell and said bell hopper causes said relative movement while said relative movement is occurring between said distributor members to cause variations in the lateral position of the charge material passing from said bell and hopper to said distributor means.

16. A method for charging particulate charge material having particles of varying sizes into a receptacle and for distributing said charge material evenly and uniformly in said receptacle, said receptacle being adapted to contain gas under pressure of which reduction of pressure is to be minimized, and said receptacle having a stockline of charge material therein, which method comprises introducing charge material in a vertical stream of compact cross section along a single path into a first hopper means above said receptacle substantially without reduction of gas pressure in said receptacle; dividing the charge material in said vertical stream without rotation in said first hopper means into a plurality of streams of substantially equal proportions without rotating the charge material; discharging each of said plurality of streams of charge material downwardly from said hopper means into said receptacle through a passage substantially without reduction of gas pressure in said receptacle; spreading charge material discharged from said first hopper means and distributing charge material as it is discharged from said hopper spreading step into said receptacle by passing said plurality of streams of charge material downwardly through means having a plurality of surfaces of different inclinations which change the directions of the charge material of said streams as it moves downwardly, to produce a substantially uniform distribution of the varying sizes of the particles of charge materials; and said spreading step and said distributing step being accomplished substantially independently of said dividing and said discharging steps.

17. The method according to claim 16 wherein said dividing step in said first hopper means is accomplished without reduction of pressure in said receptacle by sealing said first hopper means from said receptacle, and said discharging step being accomplished by pressurizing said first hopper before discharging material therefrom.

18. The method according to claim 17 wherein said first hopper includes a first port means for receiving charge material therethrough, and a second port means through which charge material is discharged after said dividing step, said sealing step during the dividing of charge material being accomplished by sealing said second port means while charge material is being delivered through said first port means and said pressurizing step including sealing both the first and second ports while said first hopper is being pressurized and subsequently discharging the divided material through said second ports.

19. The method of claim 18 in which at least one of said surfaces is moved relative to at least another of said surfaces while charge material is being discharged from said first hopper means to mix the charge material and to permit the charging material to form an even stockline in said receptacle.

20. The method of claim 16, 17, 18 or 19 comprising sensing the height of said stockline in said receptacle and in which method said plurality of streams of charge material are discharged into said receptacle upon sensing that said stockline has moved downwardly below a predetermine height.

21. The method of claim 16, 17, 18 or 19 comprising temporarily storing charge material discharged in said plurality of streams from said first mentioned hopper means in a second hopper means below said first hopper means; sensing the height of said stockline in said receptacle; and discharging charge material from said second hopper means into said receptacle upon sensing that said stockline has moved downwardly below a predetermined level.

22. The method of claim 16, 17, 18 or 19 comprising receiving charge material from a source; temporarily storing charge material above said first hopper means in a receiver hopper means; and discharging charge material into said first hopper means in said stream of compact cross section.

* * * * *

UNITED STATES PATENT OFFICE

CERTIFICATE OF CORRECTION

Patent No. 4,395,179 Dated July 26, 1983

Inventor(s) Andrejs Berzins

It is certified that error appears in the above-identified patent and that said Letters Patent are hereby corrected as shown below:

Column 7, line 7, "opeing" should be --opening--.

Column 7, line 48, "charges" should be --chargers--.

Column 8, line 17, "seal" should be --seat--.

Column 11, line 30, "on" should be --of--.

Column 24, line 50, "24.75" should be --25.75--.

Signed and Sealed this

*Twentieth* Day of *December 1983*

[SEAL]

*Attest:*

GERALD J. MOSSINGHOFF

*Attesting Officer*

*Commissioner of Patents and Trademarks*